US007205966B2

(12) United States Patent
Numao

(10) Patent No.: US 7,205,966 B2
(45) **Date of Patent: *Apr. 17, 2007**

(54) DISPLAY

(75) Inventor: Takaji Numao, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 535 days.

This patent is subject to a terminal disclaimer.

(21) Appl. No.: 10/656,299

(22) Filed: Sep. 8, 2003

(65) Prior Publication Data

US 2004/0066358 A1 Apr. 8, 2004

(30) Foreign Application Priority Data

Oct. 4, 2002 (JP) ..... 2002-292922
May 16, 2003 (JP) ..... 2003-138731

(51) Int. Cl.
*G09G 3/30* (2006.01)
*G09G 3/32* (2006.01)

(52) U.S. Cl. ..... 345/76; 345/83

(58) Field of Classification Search ..... 345/76–83, 345/204–213; 315/169.3
See application file for complete search history.

(56) References Cited

U.S. PATENT DOCUMENTS 6,501,466 B1 12/2002 Yamagishi et al.
6,509,690 B2 * 1/2003 Sempel et al. ..... 315/169.3
6,661,180 B2 * 12/2003 Koyama ..... 315/169.3
6,876,345 B2 * 4/2005 Akimoto et al. ..... 345/76
2002/0043991 A1 4/2002 Nishitobu
2003/0160745 A1 * 8/2003 Osame et al. ..... 345/82

FOREIGN PATENT DOCUMENTS

JP 2002-215095 A 7/2002
WO WO 98/48403 10/1998

OTHER PUBLICATIONS

Hattori, "Data-Line Driver Circuits for Current-Programmed Active-Matrix OLED Based on poly-Si TFTs", Digest of Technical Papers, "AM-LCD02", The Japan Society of Applied Physics, 2002 International Workshop on Active-Matrix Liquid-Crystal Displays-TFT Technologies and Related Materials, pp. 17-20.
Hunter et al.; "Active Matrix Addressing of Polymer Light Emitting Diodes Using Low Temperature Poly Silicon TFTs," AM-LCD 2000, pp. 249-252.

(Continued)

*Primary Examiner*—Alexander Eisen
(74) *Attorney, Agent, or Firm*—Nixon & Vanderhye P.C.

(57) ABSTRACT

A current driver circuit in a driver circuit generates, and maintains, a state where a drive current for an electro-optic device flows through a current output TFT and a capacitor, using a constant current output from a single constant current source during a non-drive controllable period for the pixel. The driver circuit performs the previous operation on each pixel. The current driver circuit then generates the drive current in the maintained circuit state and passes the drive current through a source line to the pixel which is in a drive controllable period by means of voltage state of the gate line, so as to control the driving of the pixel. Thus, in the pixel receiving the drive current, the drive current flows through the electro-optic device to effect a display. The current driver circuit for the electro-optic device is capable of inhibiting the current value from varying from one source line to another, while permitting construction based on a low temperature polysilicon TFT or CG silicon TFT.

15 Claims, 30 Drawing Sheets

OTHER PUBLICATIONS

Johnson et al.; "Active Matrix PolyLED Displays," IDW'00m pp. 235-238.

Tam et al.; "Improved Polysillicon TFT Drivers for Light Emitting Polymer Displays,"IDW'00, pp. 243-246.

Sasaoka et al., A 13.0-inch AM-OLED Display with Top Emitting Structure and Adaptive Current Mode Programmed Pixel Circuit (TAC), SID 01 Digest, pp. 384-387.

Inukai et al.; 4.0-in. TFT-OLED Displays and a Novel Digital Driving Method. SID 00 Digest, pp. 924-927.

Takayama et al., Continuous Grain Silicon Technology and Its Applications for Active Matrix Display, AM-LCD 2000, pp. 25-28.

R. H. Friend, "Polymer Light-Emitting Diodes for use in Flat Panel Displays," AM-LCD'01, pp. 211-214.

Abe et al., "A Poly-Si TFT 6-bit Current Data Driver for Active Matrix Organic Light Emitting Diode Displays," EURODISPLAY 2002, pp. 279-282.

* cited by examiner

DISPLAY

FIELD OF THE INVENTION

The present invention relates to organic light emitting diode (OLED) displays, field emission displays (FEDs), and other displays based on current driven devices.

BACKGROUND OF THE INVENTION

Recent years have witnessed active research and development efforts in the OLED display and FED fields. Especially, the OLED display is the focus of attention for its light emitting capability at low voltage and power and potential applications in mobile telephones, PDAs (Personal Digital Assistants), and other mobile devices.

OLED displays introduced into the market in initial periods were of simple matrix types. Active matrix types will however be the major player in the future. An OLED active device can be based on amorphous silicon TFTs, mono crystal silicon TFTs, polysilicon TFTs, and CG (Continuous Grain) silicon TFTs. The latter three groups seem to be more promising because they do not require a separate process to fabricate a driver circuit and may be more compact to drive the OLED display (due to high TFT's mobility). Especially preferred among them are low temperature polysilicon TFTs and CG silicon TFTs which can be fabricated on a glass substrate for direct view displays.

A pixel in the active matrix OLED based on a low temperature polysilicon or CG silicon has a basic circuit structure shown in FIG. 23 including two TFTs Qa, Qb, a capacitor Ca, and an OLED ELa. See for example "Active Matrix Addressing of Polymer Light Emitting Diodes Using Low Temperature Polysilicon TFTs (AM-LCD 2000, pp. 249–252)."

The driver TFT Qb is connected in series with the OLED ELa between a power source line Vref and a power source terminal Vcom. The gate and source of the driver TFT Qb sandwich the capacitor Ca. The source of Qb is connected to the power source line Vref. The gate of the selector TFT Qa is connected to a gate line Gi, while its source and drain are connected to couple the source line Sj to the gate of the driver TFT Qb. When the selector TFT Qa is turned on (ON state), the voltage on the source line Sj is applied to the capacitor Ca. The voltage thus controls the on-state resistance of the driver TFT Qb, hence the current through the OLED ELa, which in turn controls the pixel brightness. Thereafter, when the selector TFT Qa is turned off (OFF state), the capacitor Ca maintains its voltage so that the driver TFT Qb continues to be in the conducting state and the pixel brightness remains unchanged.

Applying equal voltages to the capacitors Ca so as to display intermediate tones with this structure possibly ends up with an unwelcome display where brightness varies from pixel to pixel. This is due to variations of the currents through the OLEDs ELa which in turn are caused by variations in threshold value characteristics and mobility of the driver TFTs Qb.

"Active Matrix PolyLED Displays (IDW '00, pp. 235–238)" addresses this problem. The pixel circuit structure is shown in FIG. 24. The circuitry in the figure includes a switching TFT Qc between a driver TFT Qb and an OLED ELa; a selector TFT Qa coupling a source line Sj to the connection of the driver TFT Qb and the switching TFT Qc; and a switching TFT Qd between the switching TFT Qc and a capacitor Ca. The gates of the switching TFTs Qc, Qd are both coupled to the gate line Gi.

In this structure, a current flows from a power source line Vref to the source line Sj when the switching TFT Qc is OFF and the selector TFT Qa and switching TFT Qd are both ON. The current is controlled by a current source in a source driver circuit (not shown) to set the gate voltage of the driver TFT Qb so that the driver TFT Qb conducts the current specified by the source driver circuit regardless of the threshold voltage or mobility of the driver TFT Qb. Then, the selector TFT Qa and the switching TFT Qd are turned off and the switching TFT Qc is turned on, to maintain the voltage across the capacitor Ca at that time. A current as determined by the driver TFT Qb thus flows through the OLED ELa.

FIG. 25 shows another pixel circuit structure. For details, see "Improved Polysilicon TFT Drivers for Light Emitting Polymer Displays (IDW '00, pp. 243–246)" and the Published Japanese Translation of PCT Publication 2002-514320 (Tokuhyo 2002-514320; published on May 14, 2002, a counterpart of PCT application WO98/48403). The circuitry in the figure includes a switching TFT Qg between a driver TFT Qb and a power source line Vref; a switching TFT Qf between the driver TFT Qb and a source line Sj; and a selector TFT Qe between an OLED ELa and a capacitor Ca. The gates of the switching TFTs Qf, Qg and selector TFT Qe are connected to a gate line Gi.

In this structure, a current flows from the source line Sj to the OLED ELa when the switching TFT Qg is turned off and the selector TFT Qe and switching TFT Qf are turned on. The current is controlled by a current driver circuit Pj in a source driver circuit (not shown) to set the gate voltage of the driver TFT Qb so that the driver TFT Qb conducts the current specified by the source driver circuit regardless of the threshold voltage or mobility of the driver TFT Qb. Then, the switching TFT Qf and the selector TFT Qe are turned off, and the switching TFT Qg is turned on, to maintain the voltage across the capacitor Ca at that time. A current as determined by the driver TFT Qb thus flows through the OLED ELa.

FIG. 26 shows another pixel circuit structure. For details, see "13.0-inch AM-OLED Display with Top Emitting Structure and Adaptive Current Mode Programmed Pixel Circuit (TAC) (SID '01, pp. 384–386)." The circuitry in the figure includes a driver TFT Qi between a power source line Vref and a selector TFT Qa; and a switching TFT Qh between the selector TFT Qa and a capacitor Ca. The gate of the selector TFT Qa is connected to a gate line GiA. The gate of the switching TFT Qh is connected to a gate line GiB. The driver TFTs Qb, Qi make up a current mirror circuit having a common gate. The driver TFT Qi is connected to the selector TFT Qa.

A current flows from the power source line Vref to a source line Sj when the selector TFT Qa and switching TFT Qh are turned on. The current is controlled by a current driver circuit Pj in a source driver circuit (not shown) to set the gate voltage of the driver TFT Qi so that the driver TFT Qi conducts a predetermined current regardless of the threshold voltage or mobility of the driver TFT Qi. Then, the switching TFT Qh and selector TFT Qa are turned off, to maintain the voltage across the capacitor Ca at that time. A current as determined by the driver TFT Qb thus flows through the OLED ELa.

See "4.0-in. TFT-OLED Displays and a Novel Digital Driving Method" by Semiconductor Energy Laboratory, SID '00 Digest pp. 924–927, and other publicly available literature for details of CG silicon TFTs; "Continuous Grain Silicon Technology and Its Applications for Active Matrix Display" by Semiconductor Energy Laboratory, AM-LCD 2000 pp. 25–28, and other publicly available literature for details of CG silicon TFT processes; and "Polymer Light-Emitting Diodes for use in Flat panel Display," AM-LCD '01 pp. 211–214, and other publicly available literature for details of OLED structures.

However, if each source line has a different current source in a TFT-based source driver circuit, the current varies from one source line to another, despite the intended results, due to variations in threshold value characteristics and mobility of the TFTs making up the respective current sources. The TFTs constituting the source driver circuit have properties that may vary from one TFT to another, which leads to variations in their output current and voltage and irregular brightness of the display.

The aforementioned published materials about conventional technology do not disclose the structure of the current driver circuit(s) Pj in the source driver circuit driving the source lines Sj.

A possible approach is to dispose a current driver circuit Pj for each panel or each of RGB. In such structures, the current driver circuits Pj need too high an output current frequency to realize with current TFT's performance.

Another possibility is to fabricate the source driver circuit around a mono crystal IC, not TFTs. This approach fails to make use of the advantage of the low temperature polysilicon TFT and CG silicon TFT that the driver circuit can be fabricated simultaneously as the TFTs.

SUMMARY OF THE INVENTION

The present invention has an objective to provide a display capable of preventing current from varying from one source line to another and compatible with a current driver circuit, for electro-optic devices, fabricated from low temperature polysilicon TFTs or CG silicon TFTs.

To achieve the objective, a display in accordance with the present invention includes: pixels provided at intersections of a first set of lines and a second set of lines, the pixels including respective current-driven electro-optic devices; and driver circuits which drive control the pixels through the first set of lines during a drive controllable period during which the pixels are drive controllable according to voltage states of the second set of lines, and may be arranged so that it includes a single constant current source, wherein the driver circuits generate a drive current to current drive the electro-optic devices and pass the drive current to the pixels through the first set of lines during the drive controllable period so as to drive control the pixels; create, and maintain, a circuit state where the drive current flows through the driver circuits to the pixels, using a constant current output from the constant current source during a non-drive controllable period; and generate the drive current during the drive controllable period in the maintained circuit state.

According to the invention, the driver circuit creates, and maintains, a circuit state where a drive current for the electro-optic device flows through the driver circuit, using a constant current output from a single constant current source during a non-drive controllable period for the pixel. The driver circuit performs the process on each pixel. The driver circuits however use a constant current source common to the pixels, and exhibit reduced variations in output characteristics, owing to the constant current value. As a result, a circuit state is maintained which precisely corresponds to the drive current setting for each pixel. The driver circuit generates, in the maintained circuit state, the drive current for a pixel which is in a drive controllable period according to the voltage state of the second set of lines, and pass the drive current through the first set of lines, so as to drive control the pixel. In the pixel receiving the drive current, the drive current flows through the electro-optic device to effect a display.

The driver circuit does not output high frequency current, because unlike the arrangement where a different current driver circuit is provided for each panel (or each color, RGB) to switch between currents for every pixel in drive control, the driver circuit is set for a drive current corresponding to the first set of lines using a single constant current source during a non-drive controllable period, and the driver circuit is used to specify the current value for the pixel. Therefore, the pixel can be made using low temperature polysilicon TFTs, CG silicon TFTs, or the like.

This realizes a display in which the current driver circuit for the electro-optic device is formed from low temperature polysilicon TFTs, CG silicon TFTs, or the like, while preventing current from varying from one source line to another.

To achieve the objective, another display in accordance with the present invention includes: driver circuits which drive control pixels provided at intersections of a first set of lines and a second set of lines, the pixels including respective current-driven electro-optic devices, through the first set of lines during a drive controllable period during which the pixels are drive controllable according to voltage states of the second set of lines, the driver circuits generating a drive current to current drive the electro-optic devices and passing the drive current to the pixels through the first set of lines during the drive controllable period, so as to drive control the pixels, and may be arranged so that the driver circuits create, and maintain, a circuit state where the drive current flows through the driver circuits to the pixels, using a constant current output from a single constant current source during a non-drive controllable period; and generate the drive current during the drive controllable period in the maintained circuit state.

According to the invention, the driver circuit is set for a drive current, using a single constant current source. The drive circuits exhibit reduced variations in output characteristics, owing to the constant current value. This is preferred because it restrains variations in output current among the driver circuits.

This realizes a display in which the current driver circuit for the electro-optic device is formed from low temperature polysilicon TFTs, CG silicon TFTs, or the like, while preventing current from varying from one source line to another.

To achieve the objective, another display in accordance with the present invention includes electro-optic devices provided at intersections of a first set of lines and a second set of lines, and may be arranged so that it includes: first active devices provided in series with the electro-optic devices; first capacitors connected to control terminals of the first active devices; second active devices provided between the first set of lines and the first capacitors; first switching devices provided between the first set of lines and current output terminals of the first active devices; and a fourth set of lines connected to control terminals of the first switching devices.

According to the invention, the first switching device and the second active device are made to conduct, and a predetermined current is passed from the first active device through the first switching device to the first set of lines, so as to generate a voltage to be maintained by the first capacitor. Besides, the second active device is rendered non-conducting, so as to maintain the voltage.

Therefore, if a driver circuit passing a predetermined current using a constant current output from a single constant current source is used as a driver circuit for current driving the electro-optic device, the driver circuit exhibits reduced variations in output characteristics owing to the constant current value. This realizes a display in which the current driver circuit for the electro-optic device is formed from low temperature polysilicon TFTs, CG silicon TFTs, or the like, while preventing current from varying from one source line to another.

To achieve the objective, another display in accordance with the present invention includes electro-optic devices provided at intersections of a first set of lines and a second set of lines, and may be arranged so that it includes: a third set of lines provided in parallel with the first set of lines; first active devices provided in series with the electro-optic devices; first capacitors connected to control terminals of the first active devices; second active devices provided between the third set of lines and the first capacitors; and first switching devices provided between the first set of lines and current output terminals of the first active devices.

According to the invention, the first set of lines is connected to the third set of lines, to electrically coupling the first switching device to the second active device, so as to pass a predetermined current from the first active device through the first switching device to the first set of lines. Thus, a voltage is generated which is to be maintained by the first capacitor.

Therefore, if a driver circuit passing a predetermined current using a constant current output from a single constant current source is used as a driver circuit for current driving the electro-optic device, the driver circuit exhibits reduced variations in output characteristics owing to the constant current value. This realizes a display in which the current driver circuit for the electro-optic device is formed from low temperature polysilicon TFTs, CG silicon TFTs, or the like, while preventing current from varying from one source line to another.

Besides, the first set of lines is separated from the third set of lines, to electrically coupling the first switching device to the second active device, and a predetermined voltage is applied to the third set of lines, so as to make the first active devices non-conducting. This is preferred because it sufficiently reduces the current value for the first active device in conducting state.

Additional objects, advantages and novel features of the invention will be set forth in part in the description which follows, and in part will become apparent to those skilled in the art upon examination of the following or may be learned by practice of the invention.

DESCRIPTION OF THE EMBODIMENTS

The following will describe the present invention in details by way of various embodiments.

The switching device of the present invention may be fabricated from a low temperature polysilicon TFT, CG silicon TFT, or the like. The description below will deal only with the CG silicon TFT.

The structure of the CG silicon TFT is disclosed in, for example, "4.0-in. TFT-OLED Displays and a Novel Digital Driving Method" by Semiconductor Energy Laboratory, SID '00 Digest pp. 924–927, and detailed description thereof is omitted here.

The CG silicon TFT process is disclosed in, for example, "Continuous Grain Silicon Technology and Its Applications for Active Matrix Display" by Semiconductor Energy Laboratory, AM-LCD 2000 pp. 25–28, and detailed description thereof is omitted here.

The structure of the OLED which is the electro-optic device used in the embodiments below is disclosed in, for example, "Polymer Light-Emitting Diodes for use in Flat panel Display," AM-LCD '01 pp. 211–214, and detailed description thereof is omitted here.

[Embodiment 1]

The following will describe an embodiment in accordance with the present invention with reference to figures.

The present embodiment will focus on the structure and drive method of a driver circuit and the structure of pixels in a display in accordance with the present invention.

Figure 1:
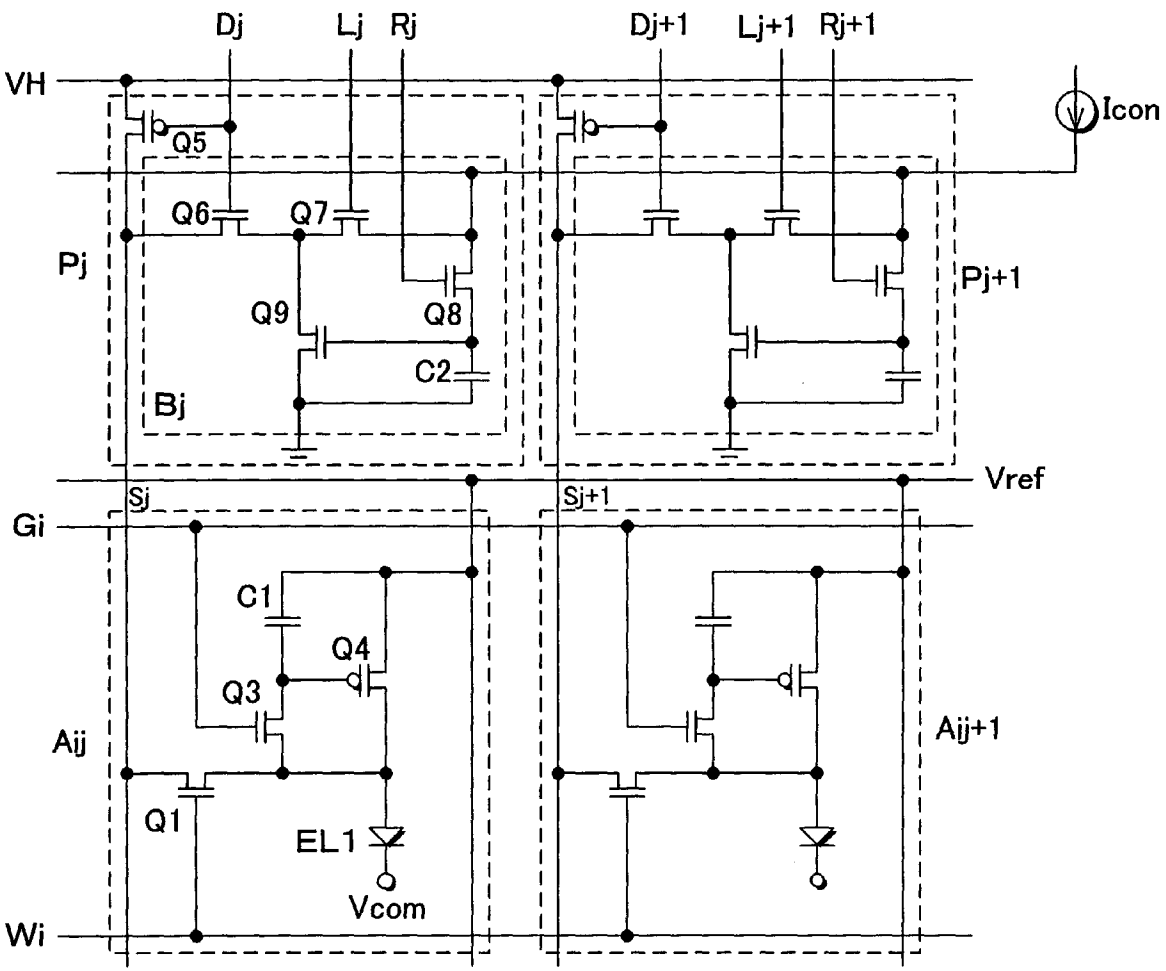
FIG. 1 is a circuit diagram showing an equivalent circuit for current drive and pixel circuitry in a display of a first embodiment in accordance with the present invention.

FIG. 1 illustrates a part of the display of the present embodiment, including a part of the driver circuit and some of the pixels in the display as respective basic arrangements.

The display includes mxn pixels Aij, arranged to form a matrix of m rows and n columns, of which FIG. 1 shows only two. This is a monochrome display in which a pixel is made of one dot for convenience in description. To display colors, the pixel is made of three dots each of which has its own electro-optic device and pixel circuit.

The circuitry of the pixel Aij in FIG. 1 is the first of all the pixel circuit structures described in the embodiments. The pixels Aij are located at intersections of source lines (a first set of lines) Sj and gate lines (a second set of lines) Gi. Each pixel has an electro-optic device EL1, an n-type switching TFT (first switching device) Q1, an n-type selector TFT (second active device) Q3, a p-type current output TFT (first active device) Q4, and a capacitor (first capacitor) C1.

The electro-optic device EL1 is an electro-optic device for current driving purposes built based on a diode. The cathode is coupled to a power source terminal Vcom. The current output TFT Q4 is connected in series with the electro-optic device EL1 between the power source terminal Vcom and a power source line Vref. The capacitor C1 is connected to the current output TFT Q4 to maintain its gate voltage. The voltage across the capacitor C1 is determined through the selector TFT Q3. The selector TFT Q3 is connected through the gate to the gate line (one of the second set of lines) Gi and couples, through the source and drain, the gate of the current output TFT Q4 to the connection point of the current output TFT Q4 and the electro-optic device EL1. The selector TFT Q3 goes on and off depending on the voltage on the gate line Gi.

The anode of the electro-optic device EL1 is connected in series with the current output TFT Q4. The switching TFT Q1 is disposed to couple, through its source and drain, the connection point to the source line Sj. The gate of the switching TFT Q1 is connected to a control line Wi. The switching TFT Q1 goes on and off depending on the voltage on the control line Wi.

The driving of the pixel Aij can be controlled by the current driver circuit Pj through the source line Sj when the voltage on the control line Wi goes HIGH, turning on the switching TFT Q1 (drive controllable period). The driving of Aij cannot be controlled by the current driver circuit Pj through the source line Sj when the voltage on the control line Wi goes LOW, turning off the switching TFT Q1 (non-drive controllable period).

The FIG. 1 current driver circuit Pj, constituting a part of the driver circuit, is now described in terms of its structure. The current driver circuit Pj controls the driving of the pixel Aij by producing a drive current which drives the electro-optic device EL1 and transmitting the current to the pixel Aij through the source line Sj during the drive controllable period of the pixel Aij.

The current driver circuit Pj includes a current source circuit Bj. The current source circuit Bj includes n-type TFTs Q6, Q7, Q8, an n-type current setting TFT Q9, and a capacitor C2. The current output TFT Q9 is connected to the source line Sj via the TFT Q6 and to an external constant current source Icon via the TFT Q7. The gate of the TFT Q6 is connected to a control line Dj; the TFT Q6 goes on and off depending on the voltage on the control line Dj. The source of the current setting TFT Q9 is grounded. The gate of the TFT Q7 is connected to the control line Lj; the TFT Q7 goes on and off depending on the voltage on the control line Lj.

The capacitor C2 is connected between the gate and source of the current setting TFT Q9. The voltage across C2 is equal to the gate voltage of the current setting TFT Q9. The TFT Q8 is a switching device connecting/disconnecting the gate of the current setting TFT Q9 to the constant current source Icon. The gate of the TFT Q8 is connected to a control line Rj; the TFT Q8 goes on and off depending on the voltage on the control line Rj.

The current driver circuit Pj includes a p-type TFT Q5 connecting/disconnecting the source line Sj to the power source line VH. The gate of the TFT Q5 is connected to the control line Dj.

Each source line has a different current driver circuit Pj, Pj+1, Pj+2, . . . , all sharing the same structure as the current driver circuit Pj. The constant current source Icon is commonly shared among all the driver circuits. In the case of a color display, the R, G, and B driver circuits are equipped with respective constant current sources Icon.

Each current driver circuit Pj forming the FIG. 1 driver circuit includes a different current source circuit Bj and therefore has an output current switching between two states: the current value as determined by the external constant current source Icon and the OFF voltage VH.

The gate width and length of the current setting TFT Q9 should be determined based on the ON-state current output from the current driver circuit Pj. The variations in the current output can be therefore reduced.

Figure 2:
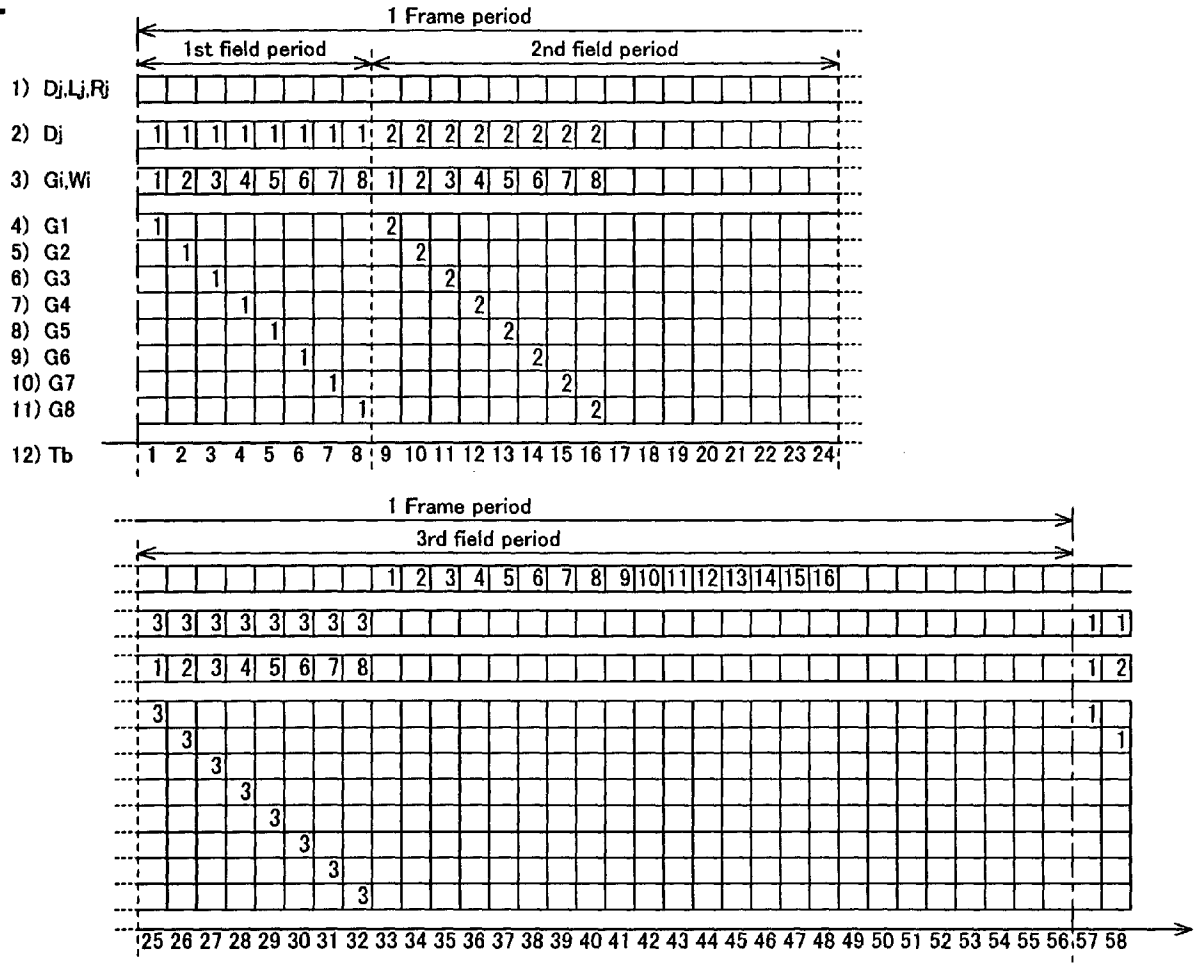
FIG. 2 is a first timing diagram showing the operation of the FIG. 1 circuit.

FIG. 2 illustrates how to produce multiple tones from the binary output current of the current driver circuit Pj.

In the figure, a frame is divided into three fields with a duration ratio of 1:2:4. The output current from the current driver circuit Pj is determined for the current output TFT Q4 in the pixel Aij at the onset of each field. The current through the electro-optic device EL1 in the pixel Aij can be changed three times in a single frame. The ratio of the display periods is 1:2:4; this allows for eight different electric charges, hence eight different tones. The numerals, 1, 2, and 3, in the Dj and G1–G8 rows indicate that the pixels are driven for the first, second, and third bit data respectively.

Still referring to FIG. 2, after determining the display state for the third field, the current values of the current driver circuits Pj are sequentially re-determined. This enables the current driver circuits Pj to output currents of an equal value in the succeeding frame. The timing chart in the figure represents a display having 8×16 pixels.

The numerals, 1 to 16, in the "1) Dj, Lj, Rj" row in FIG. 2 indicate that current is determined for the current driver circuit Pj bearing the number during that particular period. This is a current setting mode and further illustrated in the timing chart in FIG. 3.

In the mode, first, the control line Dj is set to LOW, and the n-type TFT Q6 linking the source line Sj to the current setting TFT Q9 acting also as a current output TFT is turned off, so as to prevent current leak from the current driver circuit Pj to the source line Sj. Then, in order to allow the constant current source Icon to provide a current only to the current setting TFT Q9 (acting also as a current output TFT) in the current driver circuit Pj, only the control lines Lj, Rj associated with that current driver circuit Pj are set to HIGH, while the control lines Lk, Rk associated with the other current driver circuits Pk (j≠k) are set to LOW.

This turns on the n-type TFT Q7 linking the constant current source Icon to the source of the current setting TFT Q9 (acting also as a current output TFT) in the current driver circuit Pj and the n-type TFT Q8 linking the constant current source Icon to the capacitor C2. A constant current thus flows from the constant current source Icon to the current setting TFT Q9 (acting also as a current output TFT), with the magnitude of the current determining the voltage across the capacitor C2.

The control line Rj is then set to LOW, turning off the n-type TFT Q8. The capacitor C2 maintains the voltage across it. The control line Lj is set to LOW, terminating the current setup for the current driver circuit Pj and starting a current setup for the next current driver circuit Pj+1. Consequently, the output of the current output TFT Q9 (acting also as a current setting TFT) in the current driver circuit Pj is set to a value as determined by the constant current source Icon, irrespective of variations in properties of the current output TFT Q9.

In this fashion, the current driver circuit Pj creates and maintains a circuit state in the driver circuit Pj allowing a drive current to flow through the electro-optic device EL1, using the constant current supplied from the constant current source Icon to the pixel Aij during a non-drive controllable period, and generates the drive current in the maintained circuit state during a drive controllable period. The display of the pixel Aij is determined by the duration of the current drive period during which the drive current flows through the electro-optic device EL1. The duration of the current drive period during which the drive current flows through the electro-optic device EL1 is in turn determined by the selective combination of the durations of the three fields in the frame.

Figure 3:
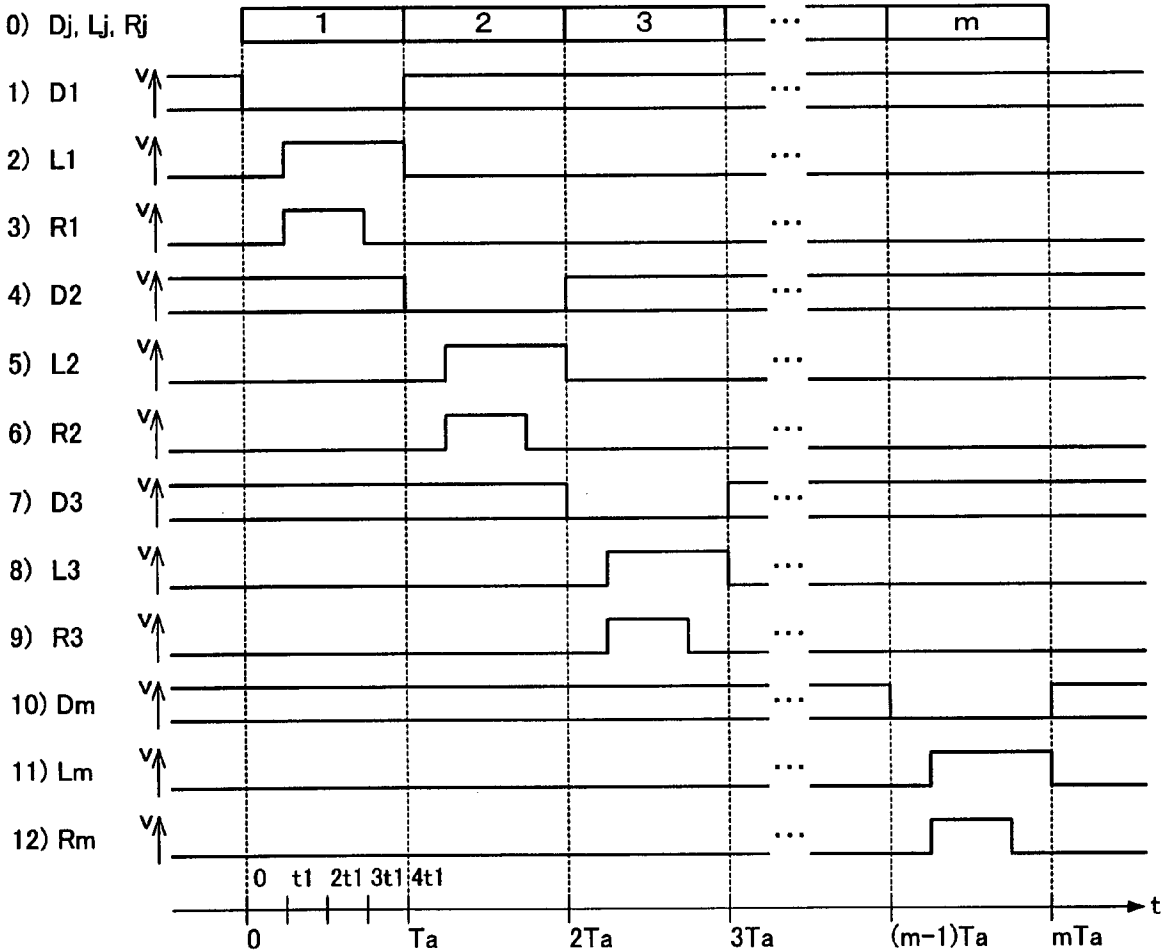
FIG. 3 is a second timing diagram showing the operation of the FIG. 1 circuit.

The period marked "1" in the "1) Dj, Lj, Rj" row in FIG. 2 corresponds to the period 0-Ta in FIG. 3. Current is determined for the current driver circuit P1 during that period. The period marked "2" in the "1) Dj, Lj, Rj" row in FIG. 2 corresponds to the period Ta-2Ta in FIG. 3. Current is determined for the current driver circuit P2 during that period. Non-marked periods in the "1) Dj, Lj, Rj" row indicate that current is not specified for none of the current driver circuits Pj during those periods.

The numerals, 1 to 8, in the "3) Gi, Wi" row in FIG. 2 indicate that current is determined for the pixels Aij bearing the number using the current driver circuit Pj during that particular period. This is a pixel select process and further illustrated in the timing chart in FIG. 4.

Figure 4:
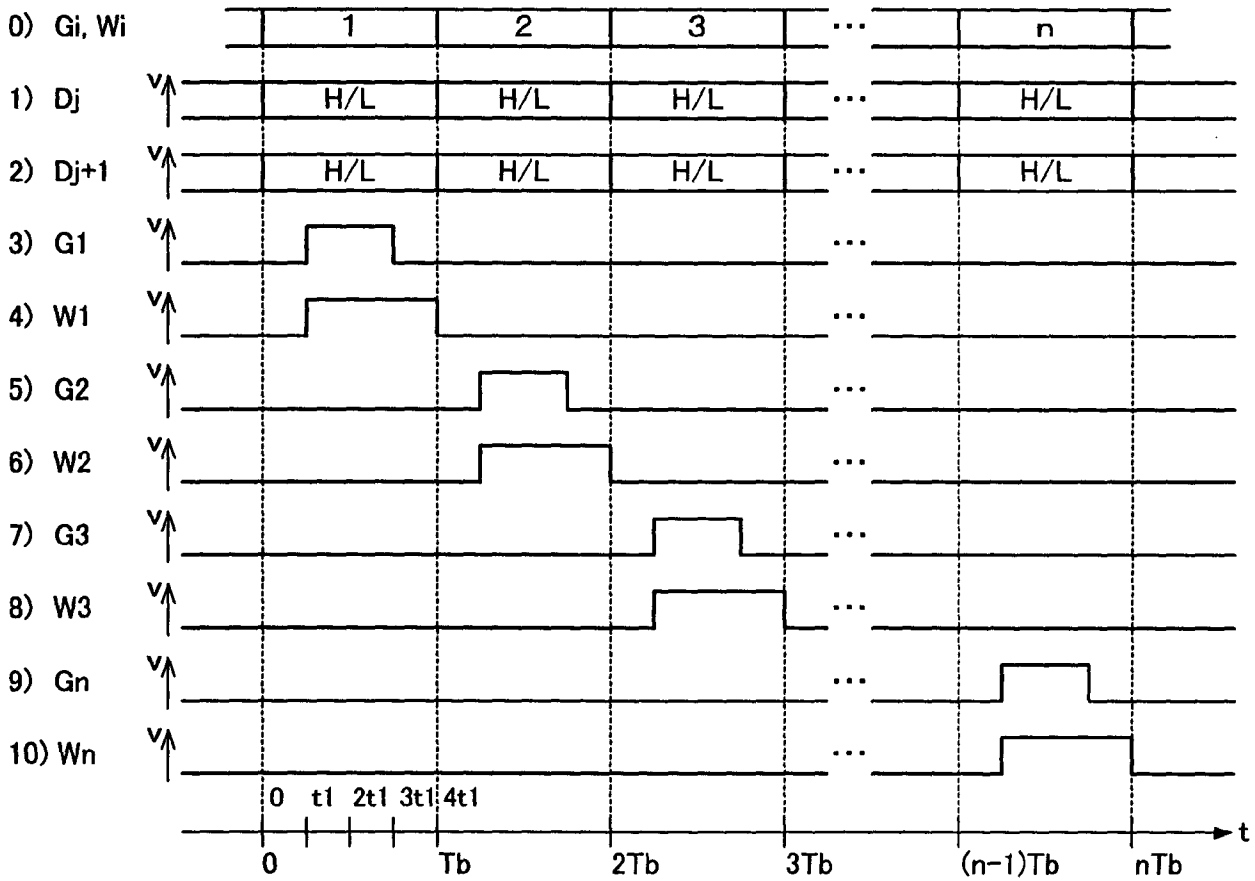
FIG. 4 is a third timing diagram showing the operation of the FIG. 1 circuit.

In the process, the data signal Dj determines at the onset of each selection period whether to couple the source line Sj to the current output TFT Q9 (marked "H" in 1), 2) in FIG. 4) or to the OFF voltage VH (marked "L" in 1), 2)in FIG. 4). Next, the control line Wi is set to HIGH, turning on the switching TFTs Q1 in the pixels Aij and closing the current path from the current output TFT Q4 to the source line Sj. The gate line Gi is also set to HIGH, turning on the selector TFT Q3 and closing the current path from the gate of the current output TFT Q4 to the source line Sj.

Under these circumstances, a LOW data signal Dj causes the source line Sj to be coupled to the OFF voltage VH, setting the voltage on the gate of the current output TFT Q4 to such a value that it turns off the current output TFT Q4. Subsequently, the gate line Gi is set to LOW, turning off the selector TFT Q3. The capacitor C1 thus maintains the gate of the current output TFT Q4 at the OFF voltage VH.

Subsequently, the control line Wi is set to LOW, turning off the switching TFTs Q1 in the pixels Aij and closing the path from the current output TFT Q4 to the electro-optic device EL1; however, in this case, the gate voltage of the current output TFT Q4 is OFF, still disabling a current to flow through the electro-optic device EL1.

In contrast, a HIGH data signal Dj causes the source line Sj to be coupled to the current source circuit Bj, enabling a current to flow from the current output TFT Q4 through the source line Sj to the current source circuit Bj. Under these circumstances, the voltage on the source line Sj settles where the value of the current through the current output TFT Q4 (acting also as a current setting TFT) matches that of the current through the current source circuit Bj. Subsequently, the gate line Gi is set to LOW, turning off the selector TFT Q3. The capacitor C1 thus maintains the gate of the current output TFT Q4 at such a voltage.

Subsequently, the control line Wi is set to LOW, closing the current path from the current output TFT Q4 to the electro-optic device EL1. The current value is equal to that determined by the current source circuit Bj.

In this fashion, to drive the electro-optic device EL1 by way of current, the current output TFT Q4 generates a drive current and passes it on to the electro-optic device EL1. The capacitor C1 holds such a voltage to be applied to the current output TFT Q4 that when current driving the electro-optic device EL1, the current output TFT Q4 generates a current equal to the drive current passed from the driver circuit Pj during a drive controllable period. The selector TFT Q3 goes ON during a drive controllable period to pass a drive current from the driver circuit Pj to the current output TFT Q4 so that the voltage across the current output TFT Q4 reaches the value given above. Following this, the selector TFT Q3 goes OFF, leaving the capacitor C1 holding that voltage. The switching TFT Q1 goes ON to couple the pixels Aij to the source line Sj. This action marks the onset of a drive controllable period. Following the voltage being built up across the capacitor C1, the switching TFT Q1 goes OFF to electrically isolate the pixels Aij from the source line Sj. This action marks the end of the controllable period. The electro-optic device EL1 is current driven in this manner.

In this example, it is during the period when the switching TFT Q1 and selector TFT Q3 are both conducting that the drive current is passed from the driver circuit Pj to the current output TFT Q4. It may be therefore safe to regard the period during which the selector TFT Q3 is conducting due to the voltage on the gate line Gi as the drive controllable period for the pixels Aij.

When the current as determined by the current source circuit Bj flows from the current output TFT Q4 to the electro-optic device EL1, the voltage on the output terminal of the current output TFT Q4 rises until the current through the electro-optic device EL1 becomes equal to the current through the current output TFT Q4.

Changing the control line Wi from HIGH to LOW decreases the magnitude of the current flow from the current output TFT Q4 to the source line Sj. However, the current driver circuit Pj attempts to maintain the current flow out of the source line Sj at a constant value, the voltage on the source line Sj falls. Meanwhile, the voltage on the output terminal of the current output TFT Q4 rises. It does not pose any problems if the voltage change on the control line Wi takes place simultaneously with the change on the gate line Gi, provided that the switching TFT Q1 and the selector TFT Q3 has only small difference in threshold value characteristics and go OFF simultaneously.

However, a possibility is that the switching TFT Q1 goes OFF before the selector TFT Q3 does so, and the current output TFT Q4 charges the capacitor C1 before the capacitor C1 is electrically isolated from the drain of the current output TFT Q4, depending on difference in the threshold value characteristics between the switching TFT Q1 and the selector TFT Q3.

When this actually happens, the current flow from the current output TFT Q4 to the electro-optic device EL1 after the control line Wi going LOW does not match the current as specified by the current source circuit Bj. Accordingly, the pixel circuit structure in the present embodiment is preferably capable of independently controlling the switching TFT Q1 and the selector TFT Q3.

The period marked "1" in the "3) Gi, Wi" row in FIG. 2 corresponds to the period 0-Tb in FIG. 4. The pixels A1j are being selected during that period. The period marked "2" in the "3) Gi, Wi" row in FIG. 2 corresponds to the period Tb-2Tb in FIG. 4. The pixels A2j are being selected during that period. Non-marked periods in the "3) Gi, Wi" row indicate that none of the pixels Aij are being selected during those periods.

In this case of a time ratio tone display, the pixel circuit driving the electro-optic devices is of a current output type, rather than a voltage output type, provided that the electro-optic devices exhibit brightness proportional to the current value.

This is because applying equal voltage to the gates of the current output TFTs Q4 in the pixel circuits Aij in FIG. 1 results in various currents flowing through the electro-optic devices vary due to ambient temperature and differences in characteristics among the electro-optic devices. In contrast, if the gate voltage of the current output TFT Q4 is set so that a constant current flows to the current output TFT Q4, the current has a prespecified value, causing no problems.

Especially when the electro-optic device of a voltage output type is shorted among other instances, power source voltage falls across the whole screen, drastically degrading display quality. In contrast, in the same situation, current output types only conduct a current of a predetermined value and does not suffer such drastic display quality degradation, which is preferable.

In the present embodiment, the current driver circuit Pj does not output high frequency current, because unlike the arrangement where a different current driver circuit is provided for each panel (or each color, RGB) to switch between currents for every pixel in drive control, the drive current from the current driver circuit Pj is set for the driver circuit corresponding to the source line using only one constant current source Icon during a non-drive controllable period, and the driver circuit is used to specify the current value for the pixel. Therefore, the pixel can be made using low temperature polysilicon TFTs, CG silicon TFTs, or the like. Besides, the output characteristics of the driver circuit can be set so that the current varies little at the constant value.

Thus, it becomes possible to form the current driver circuit Pj for current driving the electro-optic device EL1 from low temperature polysilicon TFTs, CG silicon TFTs, or the like, as well as to prevent current from varying from one source line Sj to another.

Further, the electro-optic device is current driven by determining the duration of a current drive period through selective combination of multiple periods into which a constant period is divided; therefore, it becomes possible to display, during the constant period, more tones than the number of states of the drive current from the driver circuit.

The gate line Gi transfers, to the selector TFT Q3, a voltage signal dictating the ON/OFF state of the selector TFT Q3. The control line Wi transfers, to the switching TFT Q1, a voltage signal dictating the ON/OFF state of the switching TFT Q1. This surely prevents a voltage from being produced which differs from the voltage held by the capacitor C1 due to the switching of the switching TFT Q1 before the capacitor C1 holds the voltage, and turn off the switching TFT Q1 after the capacitor C1 holds the voltage.

The capability to independently switch the switching TFT Q1 and the selector TFT Q3 between ON/OFF makes it possible to stop the current output TFT Q4 from conducting while current driving the electro-optic device EL1 after the selector TFT Q3 is turned on; therefore, it becomes possible to control duration of the current drive period of the electro-optic device EL1.

The current driver circuit Pj is a driver circuit connected to one of the source lines Sj in a display including electro-optic devices EL1, current output TFTs Q4, and capacitors C1 all located at the intersections of the source lines Sj and the gate lines Gi, and is arranged so that: the current source circuit Bj constituting the current driver circuit Pj is operative in current setting mode, and when in current setting mode, receives an external constant current so that the output current of the current source circuit Bj is specified; the current source circuit Bj outputs a current according to the specified current value and a constant voltage (voltage VH) when the current source circuit Bj is not outputting the current.

Among other things, the current driver circuit Pj is such that in current setting mode, the voltage across the capacitor C2 in the current source circuit Bj is specified according to an external current, and that the output current value for the current source circuit Bj is specified according to the voltage across the capacitor C2.

In the current source circuit Bj, the voltage across the capacitor C2 is determined by the threshold value characteristics and mobility of the current setting TFT and the current through the current setting TFT Q9 in current setting mode, and the output current of the current output TFT is determined by the voltage across the capacitor C2 and the threshold value characteristics and mobility of the current output TFT Q9.

Accordingly, using the current setting TFT Q9 and the current output TFT which are either formed from a single TFT or share similar characteristics, the effects of the threshold value characteristics and mobility of the current output TFT Q9 are offset; an equal current value is obtained across the whole display including low temperature polysilicon TFTs, CG silicon TFTs, or other TFTs with large characteristics variations.

The current source circuit Bj takes two states: it outputs an output current corresponding to the external current value or no current at all. Accordingly, current output of multiple levels is obtainable by forming the current driver circuit Pj from more than one of such a current source circuit Bj and independently controlling the presence of current outputs from the current output TFTs in the current source circuits Bj. When no current is output at all, an arrangement should be made to output a constant voltage VH.

The problems of the present invention can be solved by specifying current through the electro-optic devices EL1 located at the intersections of the source lines Sj and the gate lines Gi by means of the current driver circuit Pj.

When there is no current running through the electro-optic device EL1, a state can be taken where a constant voltage (OFF voltage) is output to the source line Sj and no current flows to the electro-optic device EL1.

The current source circuit Bj constituting the current driver circuit Pj in the driver circuit can be arranged from a current output TFT Q9 with the gate connected to a capacitor C2; a switching TFT Q8 coupling the capacitor C2 to a constant current source Icon; a switching TFT Q7 coupling the output terminal of the current output TFT Q9 to the constant current source Icon; and a selector TFT Q6 coupling the output terminal of the current output TFT Q9 to a source line Sj.

In the circuit structure, in current setting mode, only the switching TFTs Q7, Q8 in select current source circuits Bj are turned on (made to conduct), whereas the selector TFTs Q6 in those current source circuits Bj are turned off (made to stop conducting). A constant current thus flows from the constant current source Icon to the current output TFT Q9 and the capacitor C2.

Under these circumstances, turning off the switching TFT Q8 sets the voltage of the capacitor C2 to such a value that the current output TFT Q9 conducts a current as determined by the constant current source Icon. Thereafter, as the switching TFT Q7 is turned off, the current source circuit Bj exits current setting mode, and a next current source circuit Bj+1 enters current setting mode.

The circuit structure preferred because a current as determined by the constant current source Icon is output from the current source circuit Bj, despite possible variations in threshold value characteristics and mobility of the current output TFT Q9.

It is preferred also because the construction of the current source circuit Pj from multiple current source circuits Bj enables the single current source circuit Pj to output current at multiple levels.

In the present embodiment, as mentioned previously, the current driver circuit Pj is capable of output current at multiple levels. To further push up the number of tone levels achieved, a drive method may be used for a pixel Aij composed of an electro-optic device Eij and a pixel current circuit Qij operative in current setting mode. In current setting mode, the current driver circuit Pj in the driver circuit supplies current to the pixel current circuit Qij to set the current value for the pixel current circuit Qij, and the pixel current specification process is repeated in a single frame to control the tone display state of the electro-optic device Eij corresponding to the pixel Aij.

The drive method enables the pixel current circuit Qij to switch the output current value more than once in one frame and thereby achieves a display of more tones than the number of tones determined by the output current value of the current driver circuit Pj with the electro-optic device Eij.

A first preferred structure of the pixel current circuit Qij in the display of the present embodiment is such that electro-optic devices EL1, current output TFTs Q4, and capacitors C1 are all located at the intersections of source lines Sj and gate lines Gi; the gate of a current output TFT Q4 is coupled to a capacitor C1; the electro-optic device EL1 is connected in series with the current output TFT Q4; a switching TFT Q1 is provided to route the output current from the current output TFT Q4 either to the electro-optic device EL1 or the source line Sj; and a selector TFT Q3 is provided to couple/decouple the gate of the current output TFT Q4 to/from the voltage on the source line Sj.

It is preferred in the structure if the electro-optic device EL1 has asymmetric current characteristics like those of a diode.

According to the pixel circuit structure, turning on the switching TFT Q1 and applying, to the source line Sj, a voltage less than or equal to the threshold voltage of the electro-optic device EL1 renders the output voltage of the current output TFT Q4 less than or equal to the threshold voltage of the electro-optic device EL1, turns off the electro-optic device EL1, and conducts a current from the power source line Vref through the current output TFT Q4 to the source line Sj.

Under these circumstances, turning on the selector TFT Q3 sets the gate voltage of the current output TFT Q4 to a gate voltage Vlow at which the current flows.

However, if the voltage Vlow is greater than the threshold voltage of the electro-optic device EL1, current flows from the source line Sj to the electro-optic device EL1, problems occur where, for example, the dark display does not appear dark enough, and tones lose linearity at low brightness levels. However, the insufficient darkness is not seriously visible and may be ignored.

In the display of the present embodiment, it is preferred if a control line Wi runs parallel to the gate line Gi; and the gate of either the switching TFT Q1 or the selector TFT Q3 is coupled to the control line Wi, and the other to the gate line Gi.

In the circuit structure, changing the switching TFT Q1 from an ON state to an OFF state while a constant current is flowing from the current output TFT Q4 to the source line Sj alters the current supply to the source line Sj and hence the voltage on the source line Sj. Doing so also alters the voltage on the output terminal of the current output TFT Q4.

Accordingly, preferably, the selector TFT Q3 is turned off while the output current from the current output TFT Q4 is being directed to the source line by turning on the switching TFT Q1, so that a desired voltage builds up across the capacitor C1 before the voltage can change. Thereafter, the switching TFT Q1 is turned off to stabilize the current value of the current output TFT Q4.

In the circuit structure, turning on the selector TFT Q3 renders the voltage on the capacitor C1 an OFF voltage, terminating the current output from the current output TFT Q4. This is preferred because the duration of the display time is controllable for each piece of data.

[Embodiment 2]

The following will describe another embodiment in accordance with the present invention with reference to figures. Here, for convenience, members of the present embodiment that have the same function as members of embodiment 1, and that are mentioned in that embodiment are indicated by the same reference numerals and description thereof is omitted.

Embodiment 1 depicted an example where the current driver circuit Pj forming a driver circuit outputs a binary current. The present embodiment will depict an example where a current driver circuit Pj outputs current of multiple values.

Figure 5:
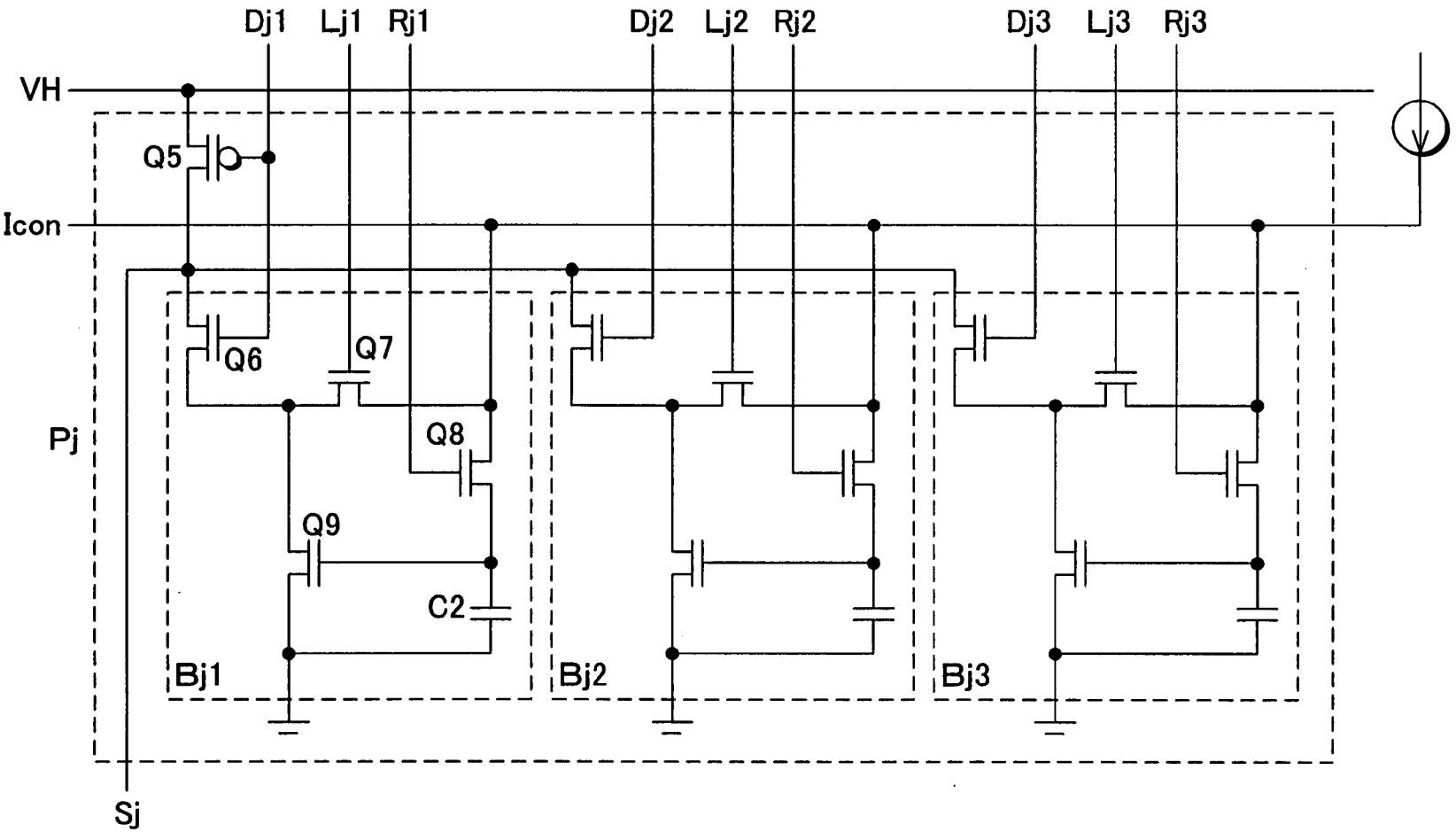
FIG. 5 is a circuit diagram showing an equivalent circuit for current driver circuitry in a display of a second embodiment in accordance with the present invention.

FIG. 5 shows an application example of the structure of a current driver circuit Pj in a display of the present embodiment.

FIG. 5 shows the current driver circuit Pj constituting a driver circuit for each source line Sj includes three current source circuits Bj1–Bj3. The current source circuits Bj each have two output states: a current value as determined by the external constant current source Icon is output or is not. Each current source circuits Bj1–Bj3 has the same structure as that of the current source circuit Bj (FIG. 1) detailed in embodiment 1.

The current source circuits Bj1–Bj3 specify current in a similar fashion as the current driver circuit Pj in embodiment 1.

Specifically, first, to prevent current from flowing from the current source circuit Bj1 to the source line Sj, the control line Dj1 is set to LOW, and the n-type TFT Q6 linking the source line Sj to the current output TFT Q9 (acting also as a current setting TFT) is turned off.

Then, in order to allow the constant current source Icon to provide a current only to the current setting TFT Q9 (acting also as a current output TFT) corresponding to the current source circuit Bj1, only the control lines Lj1, Rj1 associated with that current source circuit Bj1 are set to HIGH, while the control lines Lj1, Rj1 associated with the current source circuit Bk corresponding to another current driver circuit Pk ($j \neq k$) and other current source circuits Bj2, Bj3 for the current driver circuit Pj are set to LOW.

This turns on the n-type TFT Q7 linking the constant current source Icon to the source of the current setting TFT Q9 (acting also as a current output TFT) in the current source circuit Bj1 and the n-type TFT Q8 linking the constant current source Icon to the capacitor C2. A constant current thus flows from the constant current source Icon to the current setting TFT Q9 (acting also as a current output TFT), with the magnitude of the current determining the voltage across the capacitor C2.

The control line Rj1 is then set to LOW, turning off the n-type TFT Q8. The capacitor C2 maintains the voltage across it. The control line Lj1 is set to LOW to end the current setup for the current source circuit Bj1 and start a current setup for the next source circuit Bj2. Consequently, when the control line Dj1 is set to HIGH, the pull-in current to the current output TFT Q9 (acting also as a current setting TFT) is set to a value as determined by the constant current source Icon, irrespective of variations in properties of the current output TFT Q9.

The current source circuits Bj1, Bj2 specify current in a similar fashion as the current source circuit Bj1; description thereof is omitted.

As a result, setting all the data signals Dj1–Dj3 for the current driver circuit Pj to LOW couples the OFF voltage VH to the source line Sj and causes the current driver circuit Pj to output the OFF voltage VH to the source line Sj. Setting the data signals Dj1–Dj3 to HIGH, LOW, and LOW couples only the current source circuit Bj1 to the source line Sj, causing the current driver circuit Pj to pull in the specified current Ia from the source line Sj. Setting the data signals Dj1–Dj3 to HIGH, HIGH, and LOW couples the current source circuits Bj1, Bj2 to the source line Sj, causing the current driver circuit Pj to pull in a current double the specified current Ia from the source line Sj. Setting all the data signals Dj1–Dj3 to HIGH couples the current source circuits Bj1–Bj3 to the source line Sj, causing the current driver circuit Pj to pull in a current three times the current Ia from the source line Sj.

In this manner, current output of multiple levels is achievable using the driver circuit structure of the present embodiment.

Figure 6:
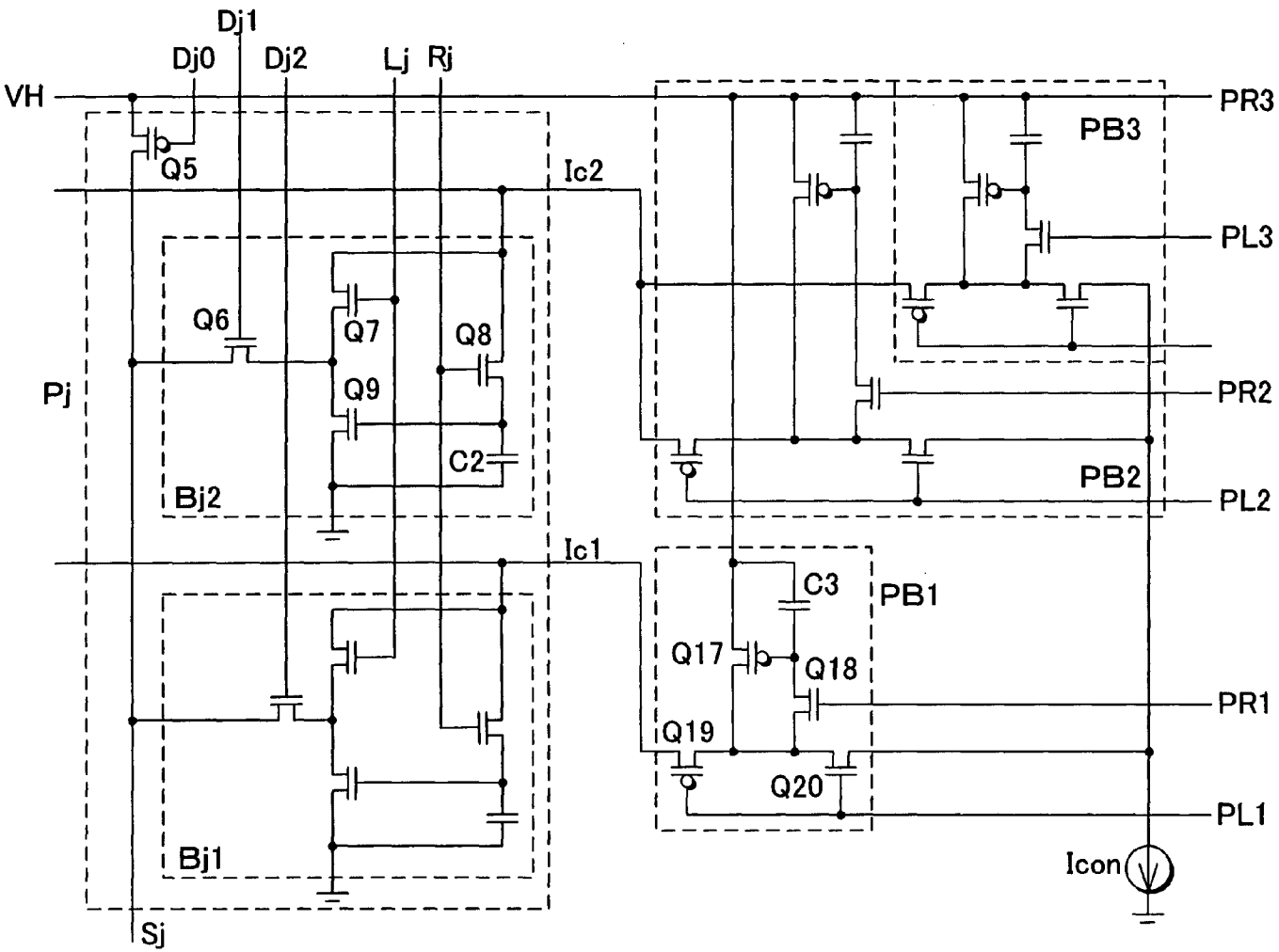
FIG. 6 is a circuit diagram showing an equivalent circuit for other current driver circuitry in the display of the second embodiment in accordance with the present invention.

Next, another example is depicted with reference to FIG. 6 where current is output at multiple levels using the driver circuit structure of the display of the present embodiment.

In the driver circuit structure in FIG. 6, each current driver circuit Pj includes current source circuits Bjx (x=1, 2, . . . ) which are set up for mutually differing current values.

To give those differing current values, the currents through the current lines Ic1, Ic2 are set to different values. The current through the current line Ic1 is produced from the constant current from the constant current source Icon by a current source circuit PB1, and the current through the current line Ic2 is produced from the constant current from the constant current source Icon by current source circuits PB2, PB3.

The current source circuit PB1 includes p-type TFTs Q17, Q19, n-type TFTs Q18, Q20, and a capacitor C3. The current source circuits PB2, PB3 has the same structure. The current source circuits PB1–PB3 specify output current in a similar fashion as the current source circuits Bj1–Bj3 in FIG. 5.

Specifically, to prevent current from flowing from the current source circuit PB1 to the current line Ic1 in the current setup for the first current source circuit PB1, the control line PL1 is set to HIGH, and the p-type TFT Q19 linking the current output TFT Q17 (acting also as a current setting TFT) to the current line Ic1 is turned off. Under these circumstances, the n-type TFT Q20 linking the current source circuit PB1 to the constant current source Icon is turned on; therefore, the n-type TFT Q18 sandwiched between the gate and the drain of the current output TFT Q17 is turned on (the control line PR1 is set to HIGH) so as to close the current path from the power source VH through the current output TFT Q17 to the constant current source Icon.

Under these circumstances, the gate voltage of the current setting TFT Q17 is set so that a constant current flows from the power source VH through the current setting TFT Q17 (acting also as a current output TFT) to the constant current source Icon. The capacitor C3 is then made to hold the gate voltage setting for the current setting TFT Q17, by turning off the n-type TFT Q18 (setting the control line PR1 to LOW). Thereafter, the control line PL1 is set to LOW to turn off the n-type TFT20 and turn on the p-type TFT19.

As a result, the current through the current line Ic1 becomes equal to the setting determined by the constant current source Icon. The process then proceeds to the current setup for the next current source circuit PB2.

The current setup for the current source circuit PB2 and the next current source circuit PB3 is similar to the current setup for the current source circuit PB1; description thereof is omitted. Under these circumstances, the current line Ic1 is only coupled to the current source circuit PB1, whereas the current line Ic2 is coupled to the current source circuits PB2, PB3. Therefore, the current value Ib on the current line Ic2 is set to double the current value Ia on the current line Ic1.

Using the current values on the current lines Ic1, Ic2, the current source circuits Bj1, Bj2 constituting the respective current driver circuits Pj are setup with respect to current.

Looking at the current setup for individual current sources Bj1, Bj2, the setup operation is similar to the current setup operation for the current driver circuit Pj in embodiment 1.

The current setup for the current driver circuit Pj first sets all the control lines Dj1–Dj2 to prevent current from flowing from the current driver circuit Pj to the source line Sj and turns off the n-type TFTs Q6 linking the source line Sj to the current setting TFTs Q9 (acting also as a current output TFTs) for the current source circuits Bj1, Bj2 constituting the current driver circuit Pj. The setup operation then sets the common control lines Lj, Rj corresponding to the current source circuits Bj1, Bj2 to HIGH and sets the common control lines Lk, Rk corresponding to other current source circuits Bk1–Bk2 (k≠j) to LOW, so that current flows from the current lines Ic1, Ic2 only to the current setting TFTs Q9 (acting also as a current output TFTs) corresponding to the current source circuit Bj1.

Under these circumstances, the n-type TFTs Q7 are turned on which link the current lines Ic1, Ic2 to the sources of the current setting TFTs Q9 (acting also as a current output TFT) in the current source circuits Bj1, Bj2; and he n-type TFTs Q8 are also turned on which link the capacitors C to the current lines Ic1, Ic2. A constant current as set up earlier flows from the current lines Ic1, Ic2 to the current setting TFTs Q9 (acting also as a current output TFTs). The voltages across the capacitors C2 determined according to the current value setting. Thereafter, the control line Rj is set to LOW, turning off the n-type TFTs Q8, so that the capacitors C2 can hold the gate voltage setting for the current setting TFTs Q9. Also, the control line Lj is set to LOW, terminating the current setup for the current driver circuit Pj. The process then proceeds to the current setup for the next current driver circuit Pj+1.

As a result, the pull-in currents for the current setting TFTs Q9 (acting also as a current output TFTs) in the current source circuits Bj1, Bj2 are set to values as determined through the current lines Ic1, Ic2 regardless of the characteristics and variations of the TFTs. Remember that here, the current value on the current line Ic2 is set to double the current value on the current line Ic1; the current value on the current source circuit Bj2 is therefore set to double the current value on the current source circuit Bj1.

Referring to FIG. 6, setting all the data signals Dj0–Dj2 to LOW couples the OFF voltage VH to the source line Sj and causes the current driver circuit Pj to output the OFF voltage VH to the source line Sj. Setting the data signals Dj0–Dj2 to HIGH, HIGH, and LOW couples only the current source circuit Bj1 to the source line Sj, causing the current driver circuit Pj to pull in the specified current Ia from the source line Sj. Setting the data signals Dj0–Dj2 to HIGH, LOW, and HIGH couples the current source circuit Bj2 to the source line Sj, causing the current driver circuit Pj to pull in a current double the specified current Ia (=2×Ia) from the source line Sj. Setting all the data signals Dj0–Dj2 to HIGH couples the current source circuits Bj1, Bj2 to the source line Sj, causing the current driver circuit Pj to pull in a current three times the determined current Ia (=3×Ia) from the source line Sj.

In this manner, current output of multiple levels is achievable using the driver circuit structure of the present embodiment.

In this manner, current output of multiple levels is achievable using the driver circuit structure of the present embodiment. To obtain 256 tones with the current driver circuit structure in FIG. 5, each current driver circuit Pj needs 255 current source circuits Bj1–Bj255. Providing such numerous current source circuits to each source line Sj would results in too large (or too wide) source drivers.

In contrast, with the current driver circuit structure in FIG. 6, 256 tones are possible if each current driver circuit Pj includes eight current source circuits Bj1–Bj8. The current supplies from the eight current source circuits Bj1–Bj8 however vary by a factor of 128. The variation is too large to fabricate all the current output TFTs Q9 in the current source circuits Bj1–Bj8 in the same size.

It may possible to increase the gate width of the current output TFTs Q9 in the current source circuits Bj1–Bj8 in proportion to the required magnitude of current; doing so is undesirable, because it would require too large (or too wide) source drivers.

[Embodiment 3]

The following will describe another embodiment in accordance with the present invention with reference to figures. Here, for convenience, members of the present embodiment that have the same function as members of embodiments 1, 2, and that are mentioned in that embodiment are indicated by the same reference numerals and description thereof is omitted.

To address the problems, the present embodiment will present a time ratio tone display method applicable to the foregoing current driver circuit structure for a multi-tone display.

Figure 7:
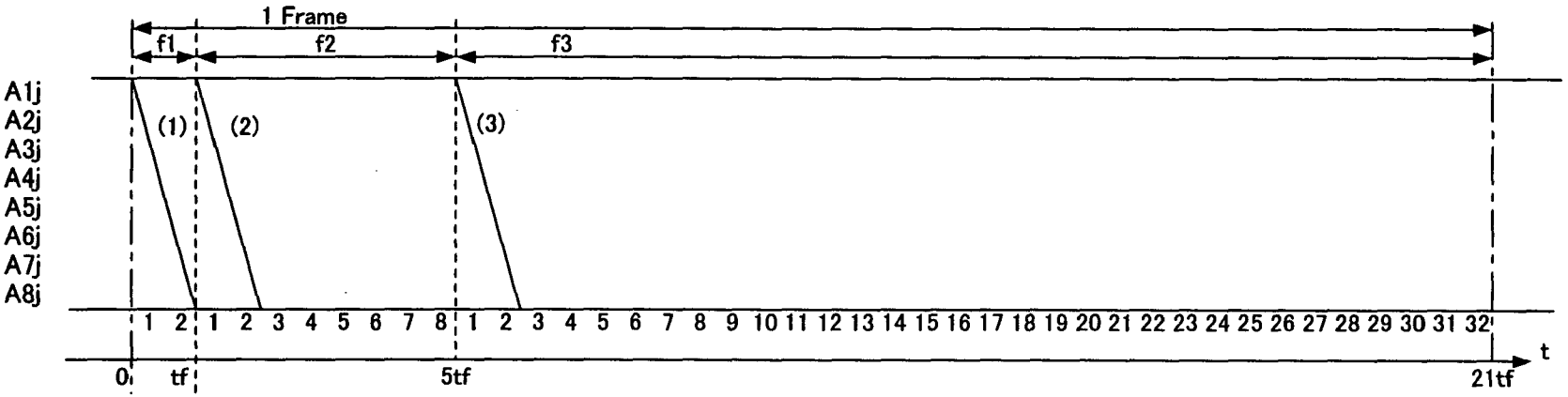
FIG. 7 is a first timing diagram showing a drive method for a display of a third embodiment in accordance with the present invention.

The current driver circuits Pj in FIGS. 5, 6 are capable of supplying a current at four values (OFF voltage, Ia, 2×Ia, 3×Ia) and when combined with three fields (time width ratio=1:4:16) in FIG. 7 based on a time division approach, producing a combined 64 tones.

FIG. 7 shows time along the horizontal axis and pixels Aij along the vertical axis, and illustrates a display having eight gate lines for convenience in discussion. A1j-A8j lined along the vertical axis are the pixels corresponding to the gate lines G1–G8. The pixels Aij are selected through the gate lines Gi at the timings indicated by oblique lines (1)–(3) in a data setup.

The data setup for the pixels Aij is similar to the one illustrated in the timing charts in FIGS. 2, 4, and detailed description thereof is omitted here.

The current driver circuit Pj specifies a current value for the current driver TFT in the pixel Aij when the gate line Gi is selected. In the operation, a new set of data is completely written to the pixels A1j–A8j corresponding to the gate lines G1–G8 in one scan period tf.

Still referring to FIG. 7, during a selection period of the gate line Gi, the pixel Aij produces a display according to the value specified for the scan period tf. Therefore, To produce a display with the time division ratio 1:4:16, one frame must be as long as (1+4+16)×tf=21×tf. In addition, actual scanning takes no more than 3×tf in the frame; the scan period accounts for a fraction of the frame.

Accordingly, dispose a selector TFT Q3 between the capacitor C1 connected to the gate of the current output TFT Q4 and the output terminal of the current output TFT Q4, and turn on the selector TFT Q3 independently of the switching TFT Q1, as in the pixel circuit Aij in FIG. 1. This renders the gate voltage of the current output TFT Q4 equal to the output voltage of the current output TFT Q4, and renders the output current of the current output TFT Q4 substantially equal to 0.

Figure 8:
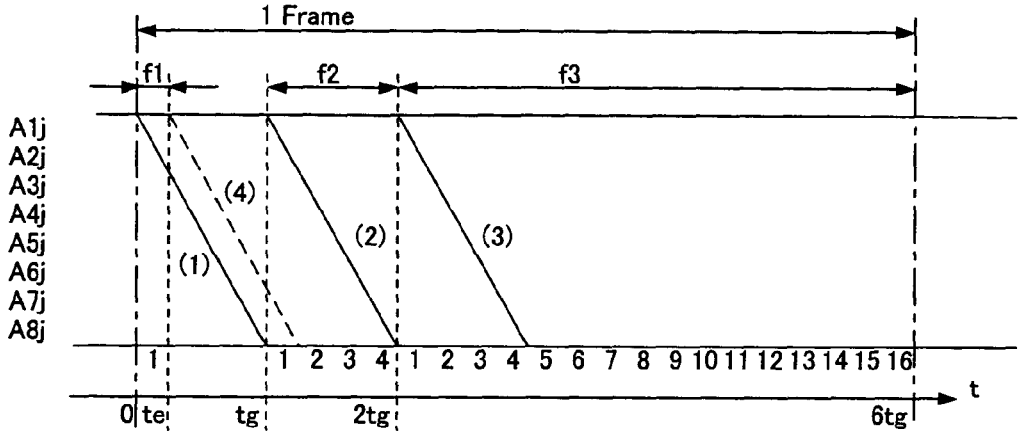
FIG. 8 is a second timing diagram showing the drive method of the display of the third embodiment in accordance with the present invention.

The output current of the current output TFT Q4 is rendered 0 (light-off operation) at the timings indicated by oblique broken line (4) in FIG. 8. The control reduces the ratio of the frame to the scan period tg to 6 as FIG. 8 shows the timings. Actual scan time in this frame remains unchanged at 3×tg.

Scanning the control line Wi independently of the gate line Gi in this manner is preferred because it shortens the frame duration.

[Embodiment 4]

The following will describe another embodiment in accordance with the present invention with reference to FIGS. 9 through 16. Here, for convenience, members of the present embodiment that have the same function as members of embodiments 1 to 3, and that are mentioned in that embodiment are indicated by the same reference numerals and description thereof is omitted.

With the pixel circuit structure in FIG. 1, embodiment 3 is not capable of reducing the output current of the current output TFT Q4 to absolute 0 in a light-off operation, because when the selector TFT Q3 is ON, the gate voltage of the current output TFT Q4 stabilizes with a small current flowing to the electro-optic device EL1.

This issue is addressed by another structure for the first pixel circuit suited to a time division tone display.

Figure 9:
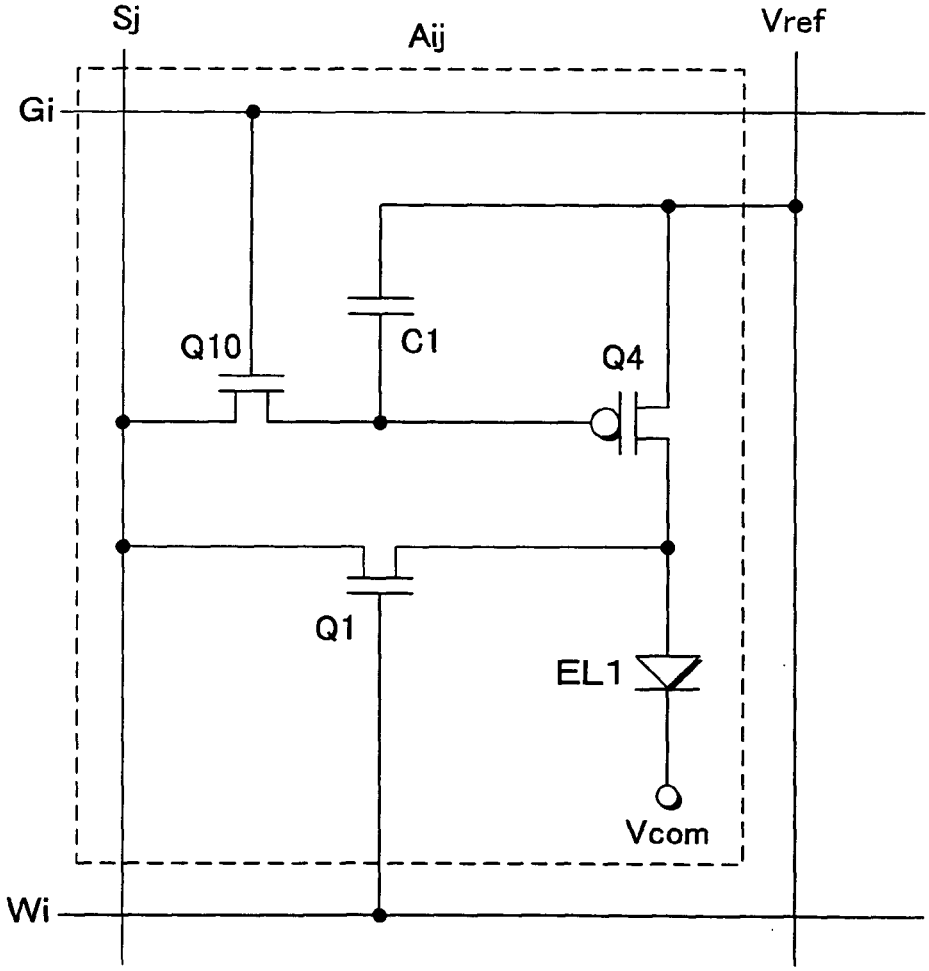
FIG. 9 is a first circuit diagram showing an equivalent circuit for pixel circuitry in a display of a fourth embodiment in accordance with the present invention.

Such a pixel circuit structure Aij is shown in FIG. 9. A selector TFT (the second active device) Q10 is provided between the gate of a current output TFT (the first active device) Q4 and a source line (one of the first set of lines) Sj. The gate of the selector TFT Q10 is connected to a gate line (one of the second set of lines) Gi. This means that the selector TFT Q10 is located between the source line Sj and a capacitor (first capacitor) C1. The current output TFT Q4 and the electro-optic device EL1 are connected in series between a power source line Vref and an opposite electrode Vcom. The gate of the current output TFT Q4 is connected to the capacitor C1. A switching TFT Q1 (first switching device) is provided between the source line Sj and the connection point of the current output TFT Q4 and the electro-optic device EL1, i.e., the current output terminal of the current output TFT Q4. The gates of the switching TFTs Q1 are connected to the control line (one of the fourth set of lines: for use with the first switching device) Wi.

Figure 10:
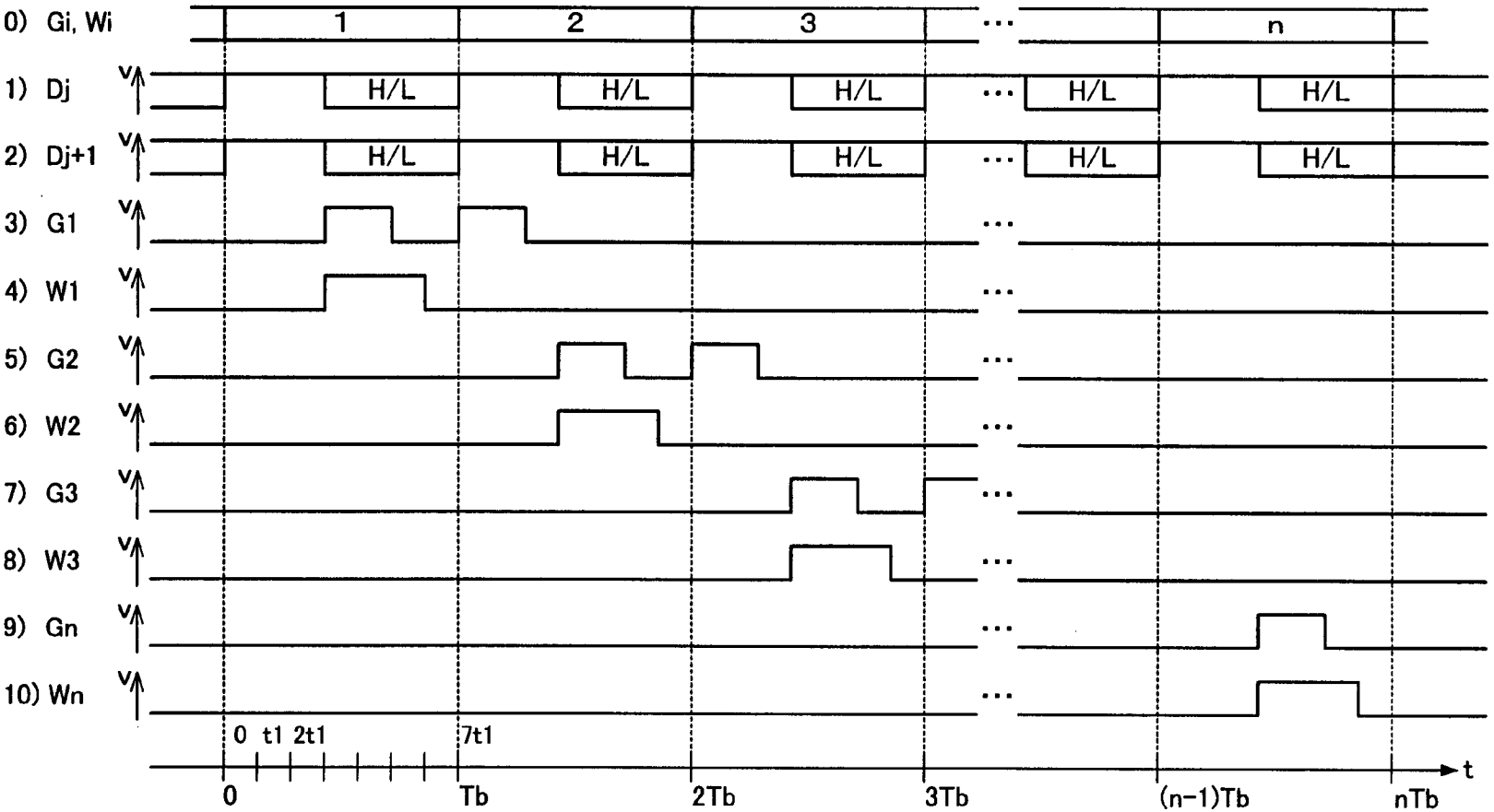
FIG. 10 is a timing diagram showing the operation of the FIG. 9 circuit.

FIG. 10 shows the current setup and erase operations for the pixel circuit Aij. The current driver circuit Pj has the same circuit structure as the one in FIG. 6.

First, all the data signals Dj0–Dj2 in FIG. 6 are set to LOW at the onset of each selection period, setting the voltage on the source line Sj to OFF voltage VH. Next, the data signals Dj0–Dj2 are each set to either LOW or HIGH in accordance with the display state of the pixel Aij, setting the current through the source line Sj to the value at which the current output TFT Q4 in the pixel Aij is to be setup. The control line Wi is then set to HIGH, closing the current path from the current output TFT Q4 in the pixel Aij to the source line Sj. Also, the gate line Gi is set to HIGH, turning on the selector TFT Q10 and electrically coupling the gate of the current output TFT Q4 to the source line Sj.

Under these circumstances, the gate voltage of the current output TFT Q4 is set so that a current flows to the source line Sj as determined by the current driver circuit Pj. The gate line Gi is set to LOW, electrically decoupling the gate of the current output TFT Q4 from the source line Sj, so that the capacitor C1 linked to the gate of the current output TFT Q4 can hold the voltage on the source line Sj.

Thereafter, the control line Wi is set to LOW so that a current of the specified value flows from the current output TFT Q4 to the electro-optic device.

Thus, the capacitor C1 can hold the voltage on the source line Sj in a state where the current output TFT Q4 is conducting a predetermined current, without being affected by variations in voltage which occur on the source line Sj when the switching TFT Q1 changes from a conducting state to a non-conducting state.

During the operation, the current through the electro-optic device in the pixel Aij assumes four different values. Similarly to the case shown in the timing chart in FIG. 8, in the first scan period tf, current termination (light-off operation) is done subsequent to this current setup. This is a timing when only the gate line Gi in FIG. 10 is HIGH. One unit time after the gate line Gi goes HIGH in the current setup, the gate line Gi is again set to HIGH at the onset, of the selection period, during which all the data signals Dj0–Dj2 are LOW.

This renders the gate voltage of the current output TFT Q4 equal to VH (voltage at which the current value of the current output TFT Q4 is regarded as sufficiently small), and thereby realizes the erase operation indicated by oblique broken line (4) in FIG. 8. This reduces the ratio of the frame to the scan period tg as low as 6. Actual scan time in this frame remains unchanged at 3×tg.

In this manner, the pixel circuit structure Aij used in the present embodiment is preferred because it is effective in shortening the frame.

A major advantage is that the gate voltage of the current output TFT Q4 can be determined through the source line Sj and the current of the current output TFT Q4 is therefore sufficiently reduced.

In the pixel circuit structure in FIG. 9, set the gate voltage of the current output TFT Q4 so that a current flows through the source line Sj as determined by the current driver circuit Pj; decouple the source line Sj from the current driver circuit Pj (the data signals Dj0–Dj2 in FIG. 6 are HIGH, LOW, and LOW) to turn off the switching TFT Q1; then keep the selector TFT (the second active device) Q10 in the OFF state. The operation causes a current to flow through the first active device as determined by the current driver circuit Pj.

If the source line Sj is set to OFF voltage (the data signals Dj0–Dj2 in FIG. 6 is LOW, LOW, and LOW) before the selector TFT (the second active device) Q10 is turned off, the capacitor C1 develops voltage which turns off the first active device. Thereafter, by turning off the second active device, the first active device can be maintained in the OFF state.

When this happens, the first active device can be turned off without producing a current flow to the electro-optic device.

In the pixel circuit structures in FIGS. 1, 9, the current termination operation (light-off operation) is carried out by changing the gate voltage of the current output TFT Q4, and therefore takes place immediately before a succeeding scan.

Now, let us compare the light-off operation as carried out immediately before a next scan to that as carried out immediately after a current scan. Occurrence of a moving image false outline is studied first.

Figure 11:
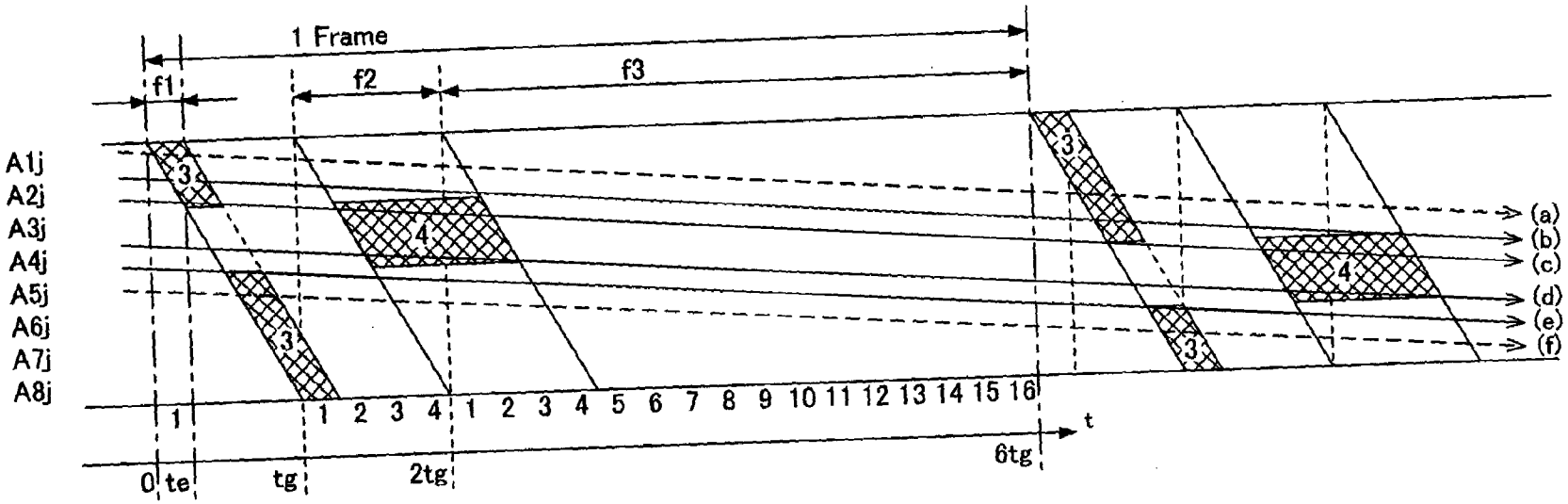
FIG. 11 is a first moving-image false outline diagram showing a first situation in which a moving image false outline occurs.

FIG. 11 illustrates how a moving image false outline occurs in a time ratio tone display carried out as in FIG. 8, and specifically, depicts a moving image false outline which appears when a fourth tone object moves on a third tone background. The viewer's eye moves after the object following arrows (a) to (f). The eye movement, combined with the time ratio display timings, produces a tone close to the seventh tone in areas like those flanked by arrows (b), (c) where light-on periods 3, 4 overlap and a tone close to the 0-th tone in areas like those flanked by arrows (d), (e) where light-on periods 3, 4 are passed through.

Figure 12:
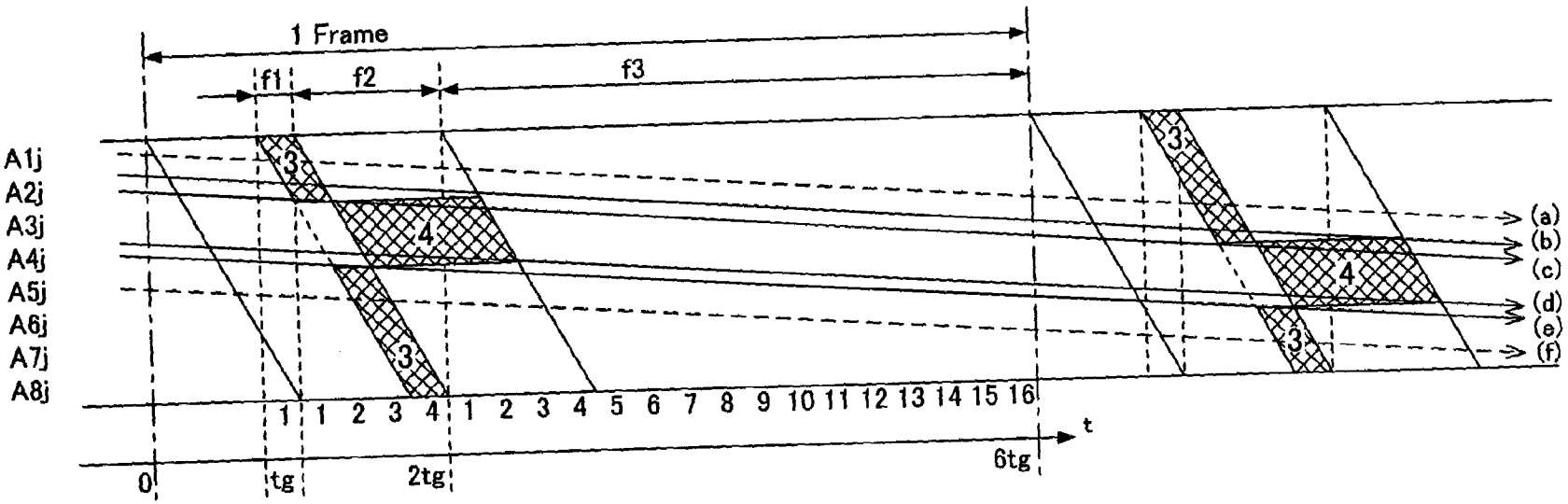
FIG. 12 is a second moving-image false outline diagram showing a second situation in which a moving image false outline occurs.

FIG. 12 illustrates an example of a light-off operation carried out immediately after a current scan. Here, a light-off operation carried out immediately after a current scan means that the light-on period f1 in the first field occurs at the end of a scan period extending from time 0 to time tg in FIG. 12.

A comparison of FIGS. 12, 11 reveals that when the time ratio increases with time as with 1:4:16 in FIG. 12, it is preferable to set the display period in the first field so that it occurs immediately before the start of scanning in the second field rather than immediately after the start of scanning in the first field, because the setting reduces the width of the area flanked by arrows (b), (c) and that flanked by arrows (d), (e) where a moving image false outline becomes visible.

Conversely, when the time ratio decreases with time as with 16:4:1, it is preferable to set the display period in a minimum field so that it occurs immediately after the start of scanning in that field as in FIG. 11.

It is preferred if information on the driver circuit structure, pixel circuit structure, and related desirable drive method may be written in the TFT panel in the manufacture of the TFT. If so, an IC-based control circuit can read the information and selects an optimal drive method and drive timings for output.

Figure 13:
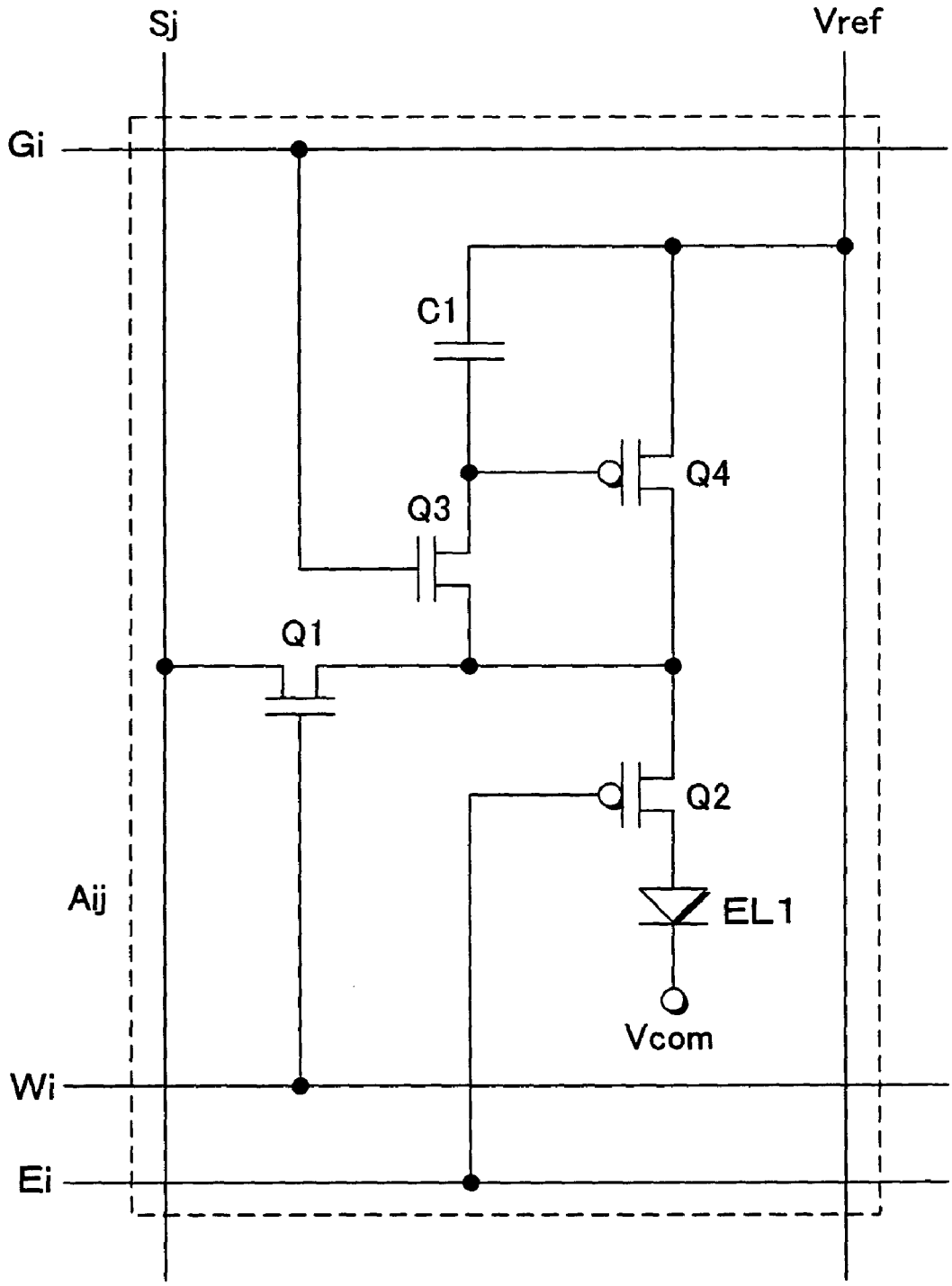
FIG. 13 is a second circuit diagram showing an equivalent circuit for pixel circuitry in the display of the fourth embodiment in accordance with the present invention.

A pixel circuit structure which implements a light-off operation immediately after a current scan as in FIG. 12 is shown in FIG. 13. The pixel circuit structure in FIG. 13 differs from that in FIG. 1 in that the gate line (one of the fourth set of line: for use with the second switching device) Ei for the switching TFT (second switching device) Q2 is provided between the current output TFT (first active device) Q4 and the electro-optic device EL1 so that the gate line Ei is independently controllable of the gate line (one of the second set of lines) Gi for the switching TFT Q1. When this is the case, the control line Wi belongs to the fourth set of lines for the first switching device, and is independent of the gate line Ei.

As a result, the switching TFT Q2 is OFF, with no display being produced, from immediately after the start of scanning in the first field until immediately before the start of scanning in the second field. A display is produced by a current of a specified value by turning on the switching TFT Q2 immediately before the start of scanning in the second field. The arrangement is therefore preferred.

In addition, the provision of the switching TFT Q2 between the current output TFT Q4 and the electro-optic device EL1 is preferable, because doing so eliminates the need for the electro-optic device EL1 to have diode characteristics and still directs the output of the current output TFT Q4 to the source line (one of the first set of lines) Sj.

The switching TFT Q2 opens/closes the drive current path from the current output TFT Q4 to the electro-optic device EL1, and therefore is readily capable of current drive even if the electro-optic device EL1 is not a diode-type device with a threshold voltage.

Figure 14:
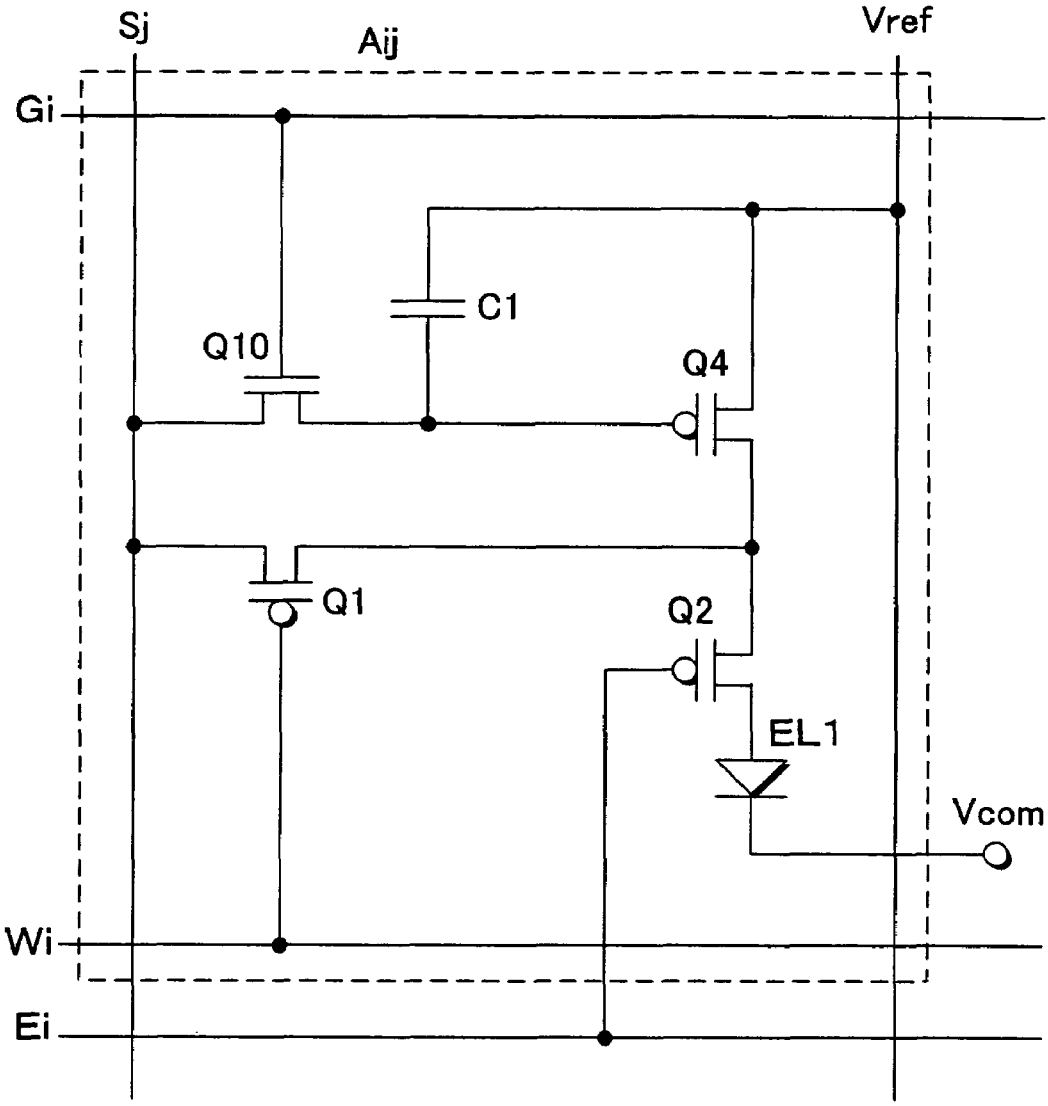
FIG. 14 is a third circuit diagram showing an equivalent circuit for other pixel circuitry in the display of the fourth embodiment in accordance with the present invention.

Similarly, the pixel circuit structure in FIG. 14 would do.

FIG. 14 shows a structure where the gate line (one of the fourth set of lines: for use with the second switching device) Ei of the switching TFT (second switching device) Q2 is disposed between the current output TFT Q4 and the electro-optic device EL1 in the pixel circuit structure in FIG. 9 so that the gate line Ei of the switching TFT Q2 is controllable independently of the gate line (one of the fourth set of lines: for use with the first switching device) Wi of the switching TFT Q1.

The capability of independently controlling the gate voltage of the current output TFT Q4 from the ON/OFF state of the current through the electro-optic device EL1 as in FIGS. 13, 14 has an advantage that the electro-optic device EL1 can be extinguished while holding the gate voltage of the current output TFT Q4. The advantage is particularly clear when the current driver circuit Pj has a binary output.

Figure 15:
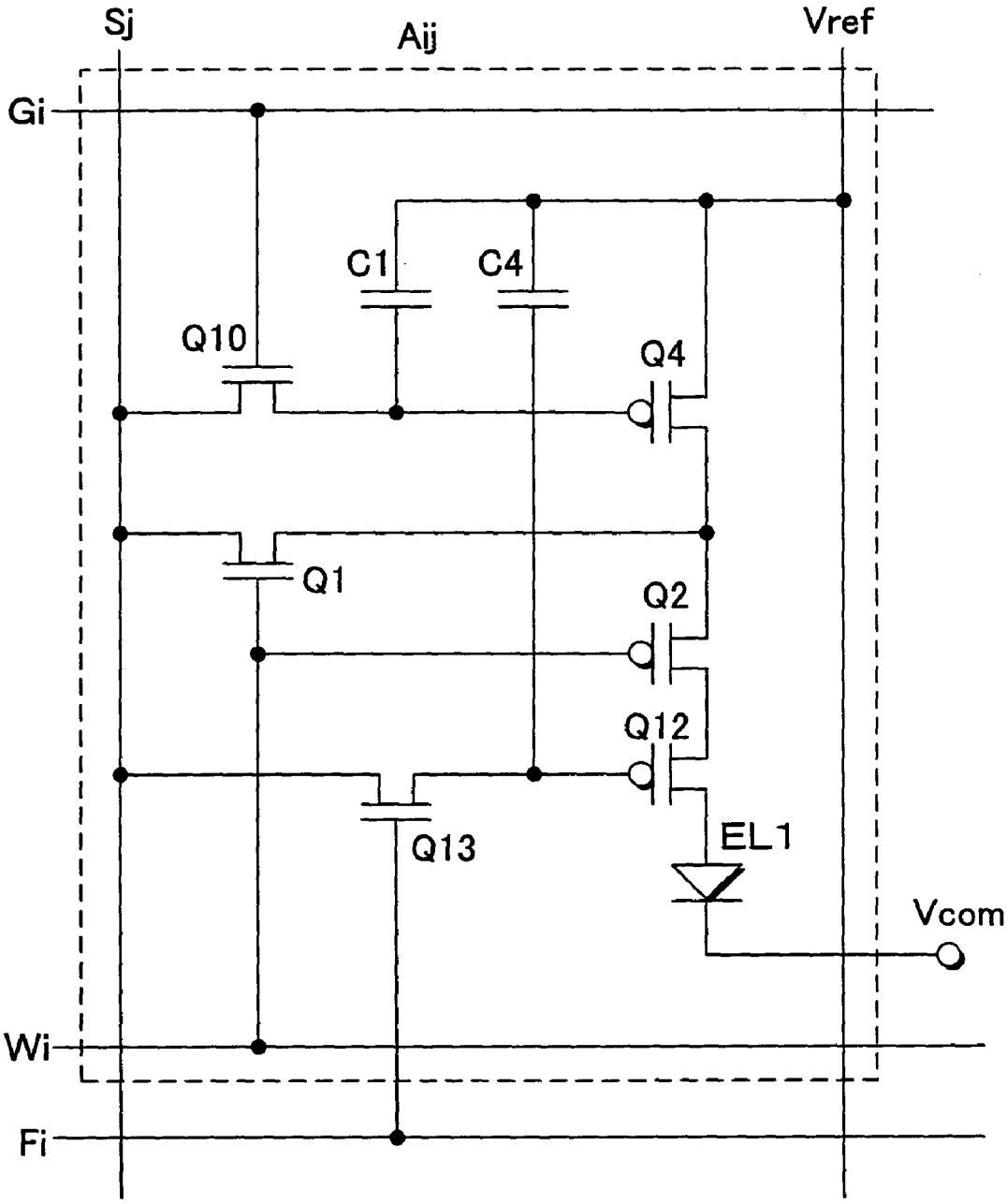
FIG. 15 is a fourth circuit diagram showing an equivalent circuit for other pixel circuitry in the display of the fourth embodiment in accordance with the present invention.

FIG. 15 shows a pixel circuit structure which embodies the advantage in more distinct form.

FIG. 15 is an example in which a switching TFT Q12, as well as a gate TFT Q13 and a capacitor C4 both connected to the gate of Q12, is provided between the switching TFT Q2 and the electro-optic device EL1 in the pixel circuit structure in FIG. 14. The gate TFT Q13 is disposed between the gate of the switching TFT Q12 and the source line Sj. The gate of Q13 is connected to a control line Fi.

Figure 16:
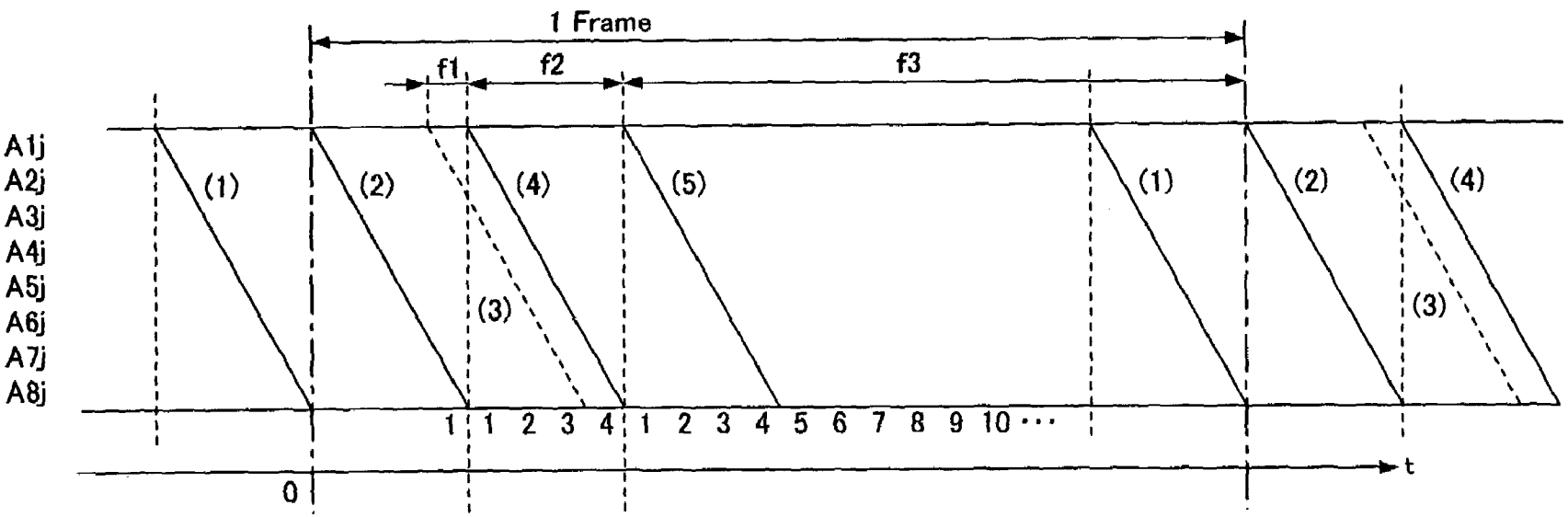
FIG. 16 is a timing diagram showing scan timings for FIG. 15.

Referring to (1) in FIG. 16, first, the output current of the current output TFT Q4 in the current driver circuit is set (timings indicated by the oblique line in (1) in FIG. 16; in this case, the output current of the current output TFT Q4 is set to ON), and then the voltage across the capacitor C4 is set (timings indicated by (2), (4), (5) in FIG. 16). This process produces a binary current output (ON state/OFF state) through about one current value setup operation per frame.

The timings indicated by the oblique line in (1) in FIG. 16 overlaps a display period f3 in the preceding third frame. Although the current setup operation disturbs the displayed image, the adverse effect is not serious because the display period f3 in the third frame is sufficiently long.

This structure is particularly effective when replacing the capacitor C4 with a static memory (composed of two inverters).

When a static memory is incorporated in the pixel producing a display, the current through electro-optic device may vary with changes in ambient temperature and characteristics of the electro-optic device, because the output of the static memory is a voltage signal. This problem with the static memory is solved by setting the output current of the current output TFT Q4 in the pixel to an ON state by the current driver circuit Pj about once per frame. The arrangement is therefore preferred.

In the present embodiment, since the switching TFT Q2 is provided between the current output TFT Q4 and the electro-optic device EL1, the electro-optic device EL1, even without diode-type asymmetric current characteristics, can produce a display.

When this is the case, the switching TFT Q1 is turned on, and the switching TFT Q2 is turned off, to pass a current from the power source line Vref through the current output TFT Q4 to the source line Sj. The switching TFT Q1 is turned off, and the switching TFT. Q2 is turned on, to pass a current from the power source line Vref through the current output TFT Q4 to the electro-optic device EL1.

In the circuit structure, the switching TFTs Q1, Q2 are preferably controlled independently so that both are OFF.

This is preferred because the switching TFT Q2 can be turned off when the switching TFT Q1 is OFF, and the current flow from the current output TFT Q4 to the electro-optic device EL1 can be stopped to control the duration of display time for each piece of data.

[Embodiment 5]

The following will describe another embodiment in accordance with the present invention with reference to FIGS. 17 to 19 and FIGS. 27 to 32. Here, for convenience, members of the present embodiment that have the same function as members of embodiments 1 to 4, and that are mentioned in that embodiment are indicated by the same reference numerals and description thereof is omitted.

Figure 17:
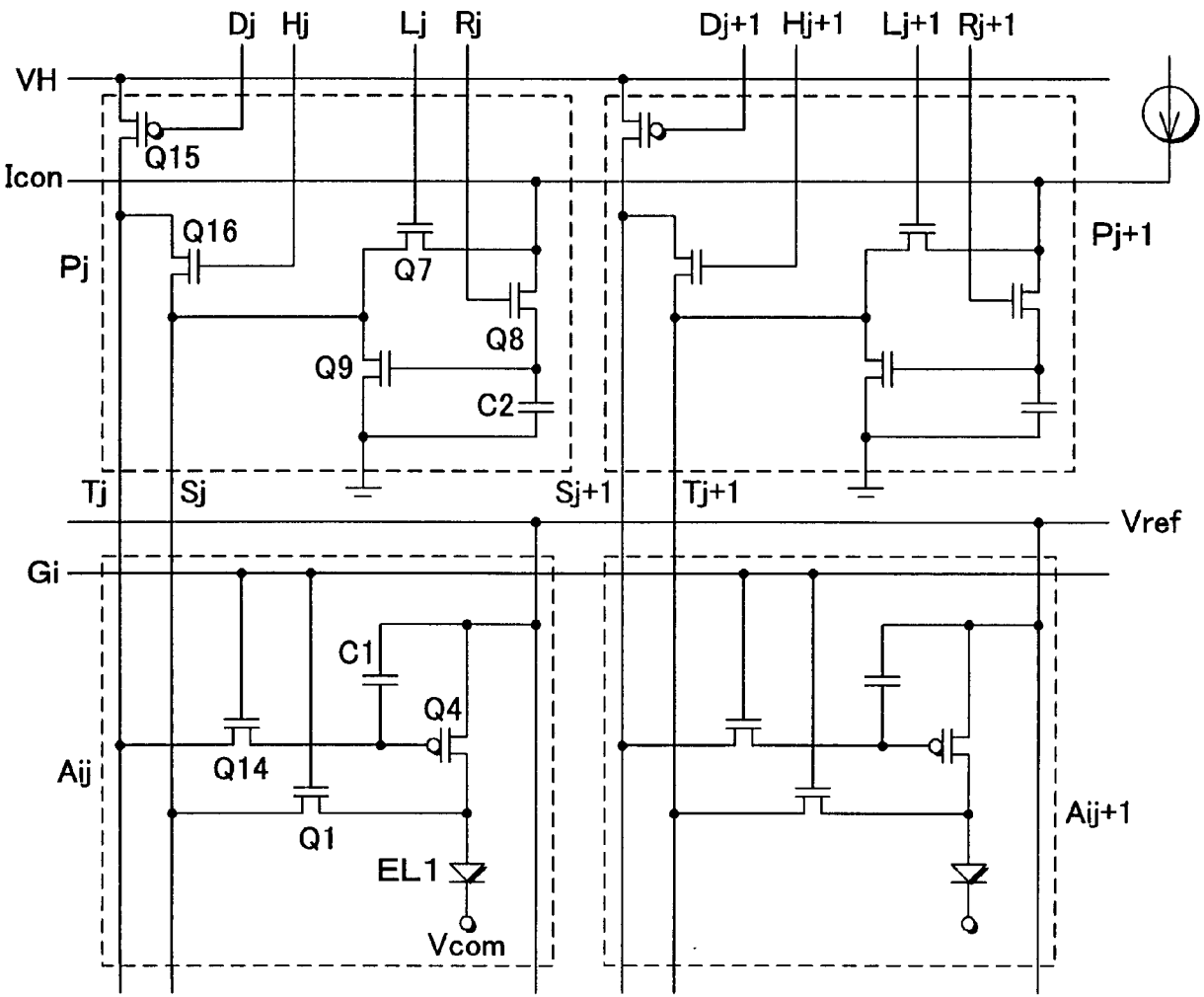
FIG. 17 is a circuit diagram showing an equivalent circuit for current drive and pixel circuitry in a display of a fifth embodiment in accordance with the present invention.

The present embodiment will present an example of a second pixel circuit structure. FIG. 17 shows the pixel circuit structure Aij where data lines (a third set of lines) Tj run parallel to source lines (a first set of lines) Sj. A selector TFT (the second active device) Q14 is provided between each data line Tj and the gate of an associated current output TFT (first active device) Q4. The gate of the selector TFT Q14 is connected to a gate line (one of the second set of lines) Gi. This means that a selector TFT Q14 is located between each data line Tj and an associated capacitor (first capacitor) C1. Between the current output terminal of the current output TFT Q4 and the source line Sj is there provided a switching TFT (first switching device) Q1 of which the gate is connected to the gate line Gi.

Figure 18:
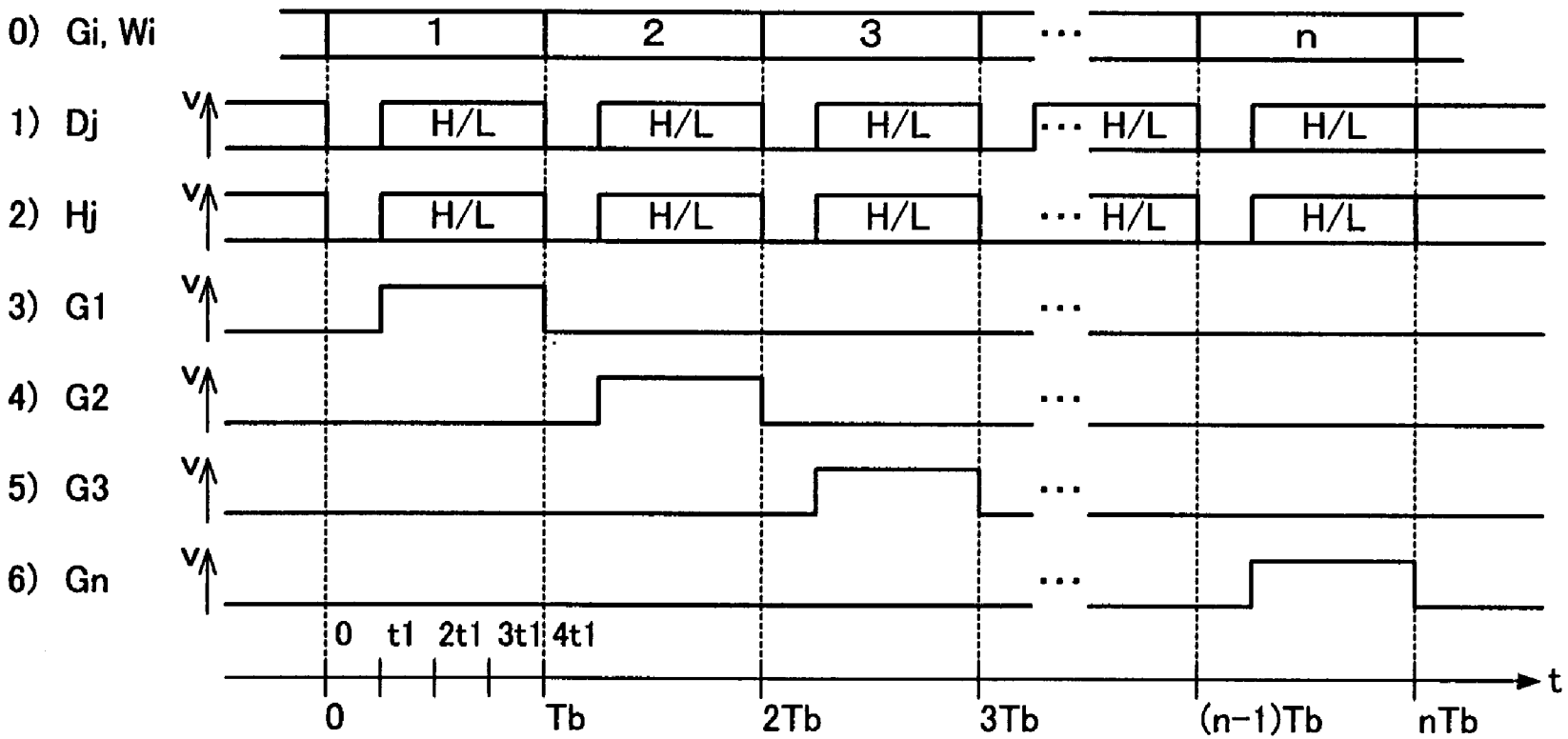
FIG. 18 is a timing diagram showing the operation. of the FIG. 17 circuit.

The pixel circuit structure Aij is setup with respect to current as shown in the timing chart in FIG. 18.

Specifically, at the onset of the selection period, the control lines Dj, Hj for the current driver circuit Pj are both set to LOW, coupling the data line Tj to the OFF voltage line VH and decoupling the data line Tj from the source line Sj. Under these circumstances, the source line Sj is electrically coupled to the current output TFT Q9 in the current driver circuit Pj. The source line Sj thus discharges and assumes a low voltage state Vlow. Next, the gate line Gi is set to HIGH (Gi is selected), and it is determined whether the control lines Dj, Hj are both set to HIGH or LOW.

If both the control lines Dj, Hj are set to LOW, the voltage on the data line Tj becomes equal to the OFF voltage VH. The OFF voltage VH being applied to the gate of the current output TFT Q4 in the pixel circuit Aij, the current output TFT Q4 is not conducting. With the switching TFT Q1 conducting, the source line Sj is electrically coupled to the output terminal of the current output TFT Q4. The voltage on the source line Sj however remains at the voltage Vlow because the current output TFT Q4 is not conducting.

Under these circumstances, the electro-optic device, connected to the output terminal of the current output TFT Q4, does not conduct if the electro-optic device has diode-like applied-voltage-versus-current characteristics. Specifically, in the FIG. 17 circuit structure, the voltage Vlow is applied to the anode of the electro-optic device EL1 connected to the output terminal of the current output TFT Q4. Setting the voltage on the source line Sj to about an opposite electrode voltage Vcom under these circumstances prevents the electro-optic device EL1 from conducting.

Still referring to the FIG. 17 pixel circuit structure Aij, the OFF voltage is applied to the gate of the current output TFT Q4, setting the voltage on the source line Sj approximately to GND.

Thereafter, if the gate line Gi is deselected, and the selector TFT Q14 and switching TFT Q1 are turned off, the electro-optic device EL1 continues to be prevented from conducting.

In contrast, if both the control lines Dj, Hj are set to HIGH, the data line Tj is coupled with the source line Sj, and the voltages on Tj, Sj become equal to each other. Under these circumstances, the voltage on the data line Tj changes from the voltage VH in the direction of the voltage Vlow on the source line Sj, causing the current output TFT Q4 to conduct.

Also, since the switching TFT Q1 conducts, a current flows from the current output TFT Q4 through the source line Sj, etc. to the current driver circuit Pj. The gate voltage of the current output TFT Q4 changes so that the current flow from Q4 to Pj becomes equal to the value determined by the current driver circuit Pj, stabilizing the data line Tj and the source line Sj.

The voltage on the source line Sj here also does not allow the electro-optic device EL1 to conduct.

In other words, in the FIG. 17 circuit structure, the current output TFT Q4 conducts, and the gate voltage of the current output TFT Q4 therefore falls to a level 2 V to 3 V lower than the power source voltage Vref. In contrast, if the electro-optic device has diode-type characteristics, a fall in anode voltage as small as 2 V to 3 V inhibits the electro-optic device from conducting any substantial current.

Thereafter, to maintain the gate voltage of the current output TFT Q4, the data line Tj is electrically decoupled from the current driver circuit Pj and the source line Sj, and the gate line Gi is deselected.

The FIG. 17 pixel circuit structure Aij is preferable because the selector TFT Q14 and the switching TFT Q1 are individually connected to the data line Tj and the source line Sj as discussed in the foregoing. The individual connection prevents variations in voltage occurring when the switching TFT Q1 changes from ON to OFF from affecting the gate voltage of the current output TFT Q4, despite the fact that the gates of the selector TFT Q14 and the switching TFT Q1 are both connected to the gate line Gi.

In FIG. 17 the current output TFT Q9 in the current driver circuit Pj is always coupled to the source line Sj. Alternatively, a selector TFT Q6 may be provided so that the current output TFT Q9 is electrically decoupled from the source line Sj only when the current driver circuit Pj is setup with respect to current as in FIG. 1.

As discussed in the foregoing, in the present embodiment, the data line Tj is provided to transfer the voltage needed by the current output TFT Q4 to make a voltage setting through the conducting selector TFT Q14, not through the switching TFT Q1, to the current output TFT Q4. The switching TFT Q1 conducts, thereby connecting the source line Sj to the current output terminal of the current output TFT Q4, hence, to the terminal through which the electro-optic device EL1 receives a drive current (anode).

Therefore, supposing that the electro-optic device EL1 is a diode-type electro-optic device having a threshold voltage, to produce a dark state, a voltage at which the current output TFT Q4 does not conduct is transferred from the data line Tj through the selector TFT Q14 to the current output TFT Q4, and a voltage which causes the voltage applied to the electro-optic device EL1 to be less than or equal to the threshold voltage is transferred from the source line Sj through the switching TFT Q1 to the terminal through which the electro-optic device EL1 receives a drive current (anode). This makes the electro-optic device EL1 appear completely dark.

According to the arrangement in FIG. 17, the voltage to be maintained by the capacitor C1 can be generated by linking the source line Sj to the data line Tj, turning on the switching TFT Q1 and the selector TFT Q14, passing a predetermined current from the current output TFT Q4 through the switching TFT Q1 to the source line Sj.

Besides, the current output TFT Q4 can be made non-conducting by separating the source line Sj from the data line Tj, turning on the switching TFT Q1 and the selector TFT Q14, and applying a predetermined voltage to the data line Tj. Consequently, the current through the non-conducting current output TFT Q4 is reduced to a sufficiently small value. The arrangement is therefore preferred.

Figure 19:
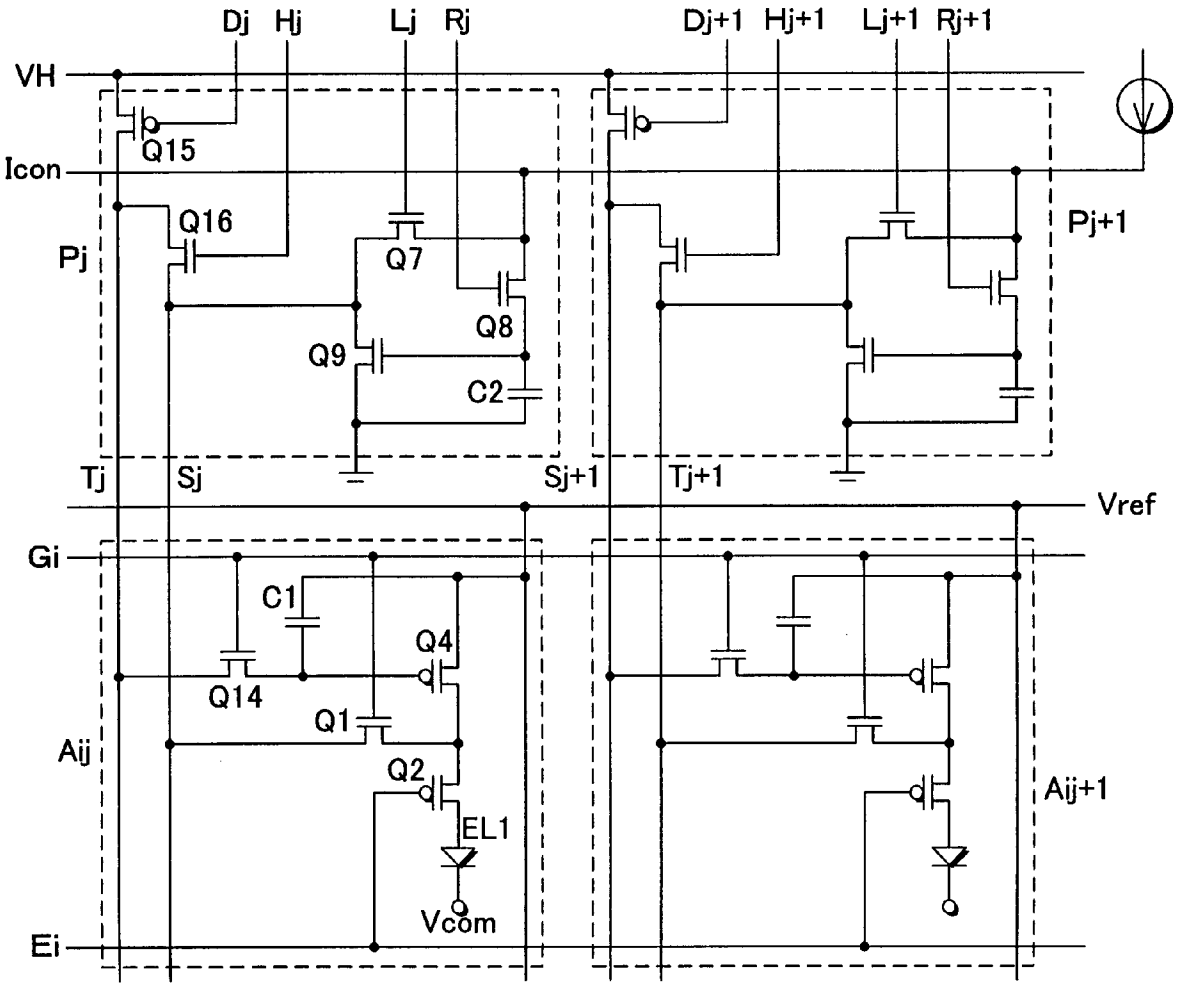
FIG. 19 is a circuit diagram showing an equivalent circuit for other current drive and pixel circuitry in the display of the fifth embodiment in accordance with the present invention.

If the electro-optic device is not a diode-type, a switching TFT Q2 (second switching device) may be provided between the current output TFT Q4 and the electro-optic device EL1 in the pixel circuit structure in FIG. 17 as in the FIG. 19 pixel circuit structure. The arrangement directs the output current of the current output TFT Q4 to the source line Sj regardless of the characteristics of the electro-optic device EL1, and when the source line Sj is electrically coupled to the data line Tj, determines current control terminal voltage so that the current output TFT Q4 conducts a desired current. As a result, the variations in the output current of the current output TFT Q4 are restrained. The arrangement is therefore preferred.

Figure 27:
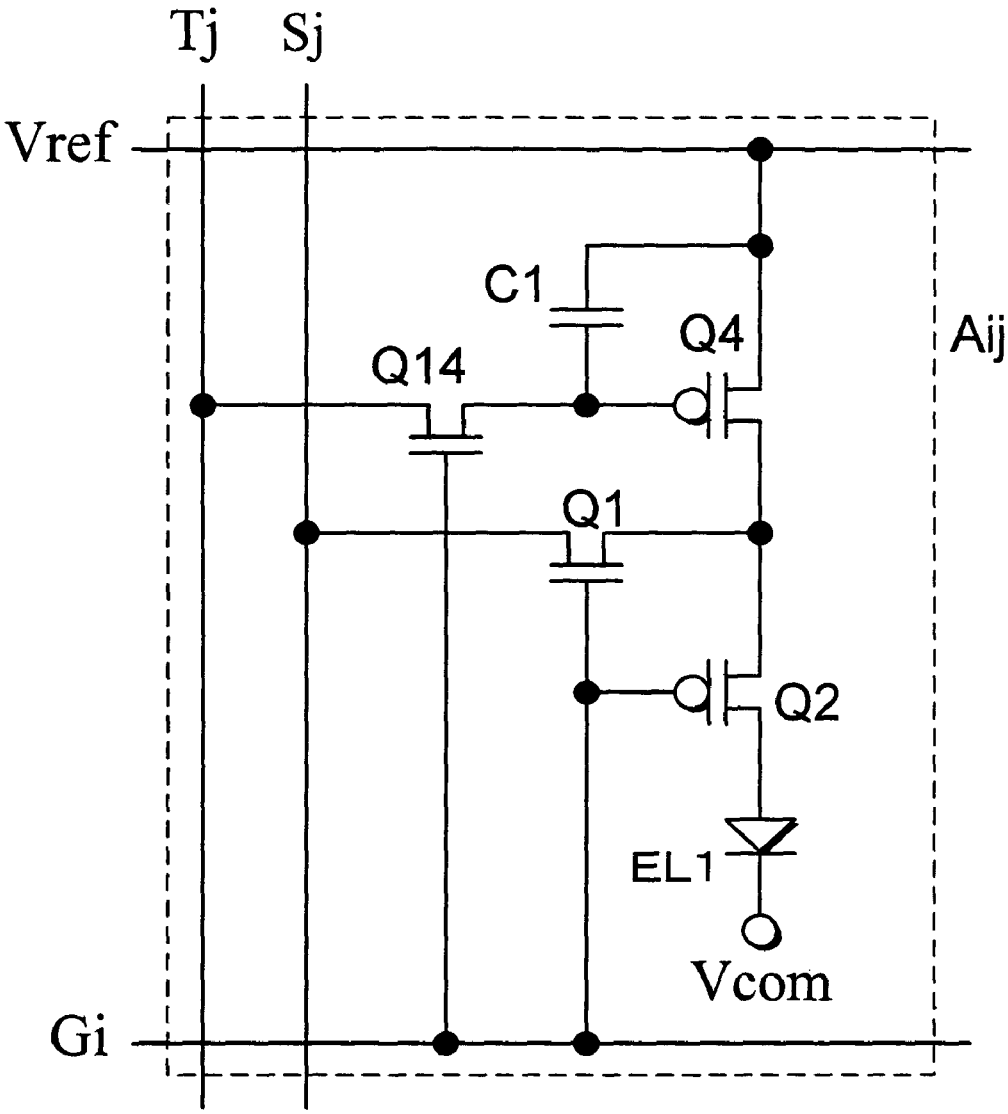
FIG. 27 is a circuit diagram showing an equivalent circuit for other pixel circuitry in the display of the fifth embodiment in accordance with the present invention.

The gate of the switching TFT Q2 may be linked to another line (one of the fourth set of lines: for use with the second switching device) Ei as in FIG. 19. Further, in the FIG. 17 pixel circuit structure, a switching TFT (second switching device) Q2 may be provided between the current output TFT Q4 and the electro-optic device EL1 with the gate of the switching TFT Q2 connected to the gate line Gi, as shown in FIG. 27. Further, a power source line Vref may be provided parallel to the gate line Gi as in FIG. 27. Further, in the FIG. 19 pixel circuit structure, another line Ei may be provided as a control line (one of the fourth set of lines: for use with the first and second switching devices) Wi, with the gate of the selector TFT Q14 connected to the gate line Gi and the gates of the switching TFT Q1 and the switching TFT Q2 connected to the control line Wi as in FIG. 28.

The FIG. 19 pixel circuit structure is preferable because it enables the light-off operation as in FIG. 12 by connecting the gate of the switching TFT Q2 to a separate line, Ei, from the gate line Gi.

Figure 28:
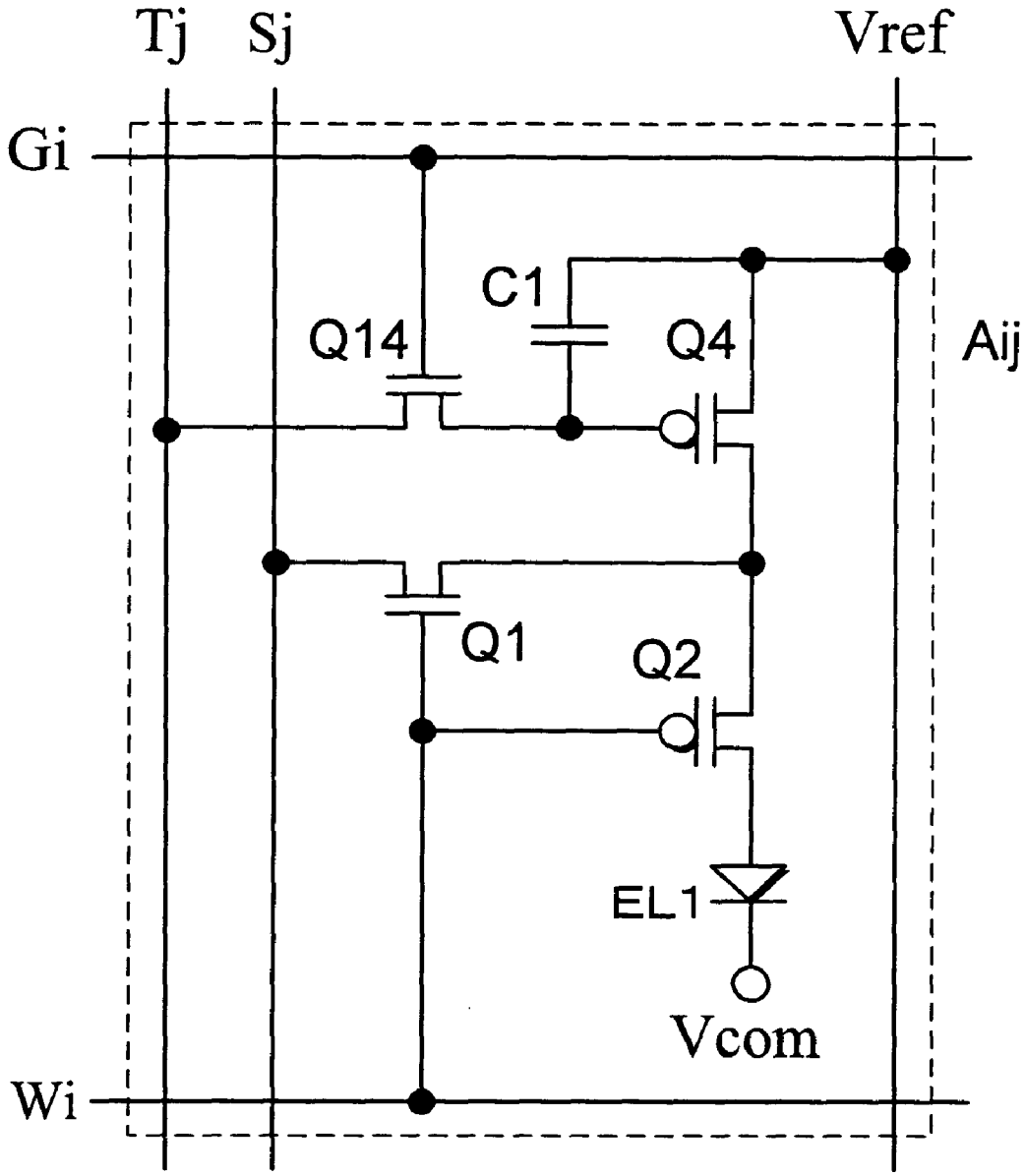
FIG. 28 is a circuit diagram showing an equivalent circuit for other pixel circuitry in the display of the fifth embodiment in accordance with the present invention.

Besides, the switching TFT Q1 can be made non-conducting after the selector TFT Q14 is made non-conducting, because the selector TFT Q14 and the switching TFT Q1 can be controlled independently by controlling the conduction/non-conduction of the switching TFT Q1 and the selector TFT Q14 through individual lines as in FIG. 28. As a result, the capacitor C1 can hold the voltage with the current output TFT Q4 conducting a predetermined current, and variations in the output current value can be restrained. The arrangement is therefore preferred.

A second preferred arrangement of the pixel current circuit Qij in the display of the present embodiment includes: an electro-optic device EL1, current output TFT Q4, and capacitor C1 provided at each of the intersections of source lines Sj and gate lines Gi; and data lines Tj provided parallel to the source lines Sj, wherein the capacitor C1 is provided to the gate of the current output TFT Q4, the current output TFT Q4 is provided in series with the electro-optic device EL1, a switching TFT Q1 is provided which switches the output current of the current output TFT Q4 between the electro-optic device EL1 and the source line Sj, and a selector TFT Q14 is provided which selects whether to couple the voltage on the data line Sj to the gate of the current output TFT Q4.

In the pixel circuit structure, a current can be passed from the power source line Vref through the current output TFT Q4 to the source line Sj by turning on the switching TFT Q1, applying a voltage less than or equal to the threshold voltage of the electro-optic device EL1 to the source electrodes, and turning off the electro-optic device EL1. Meanwhile, the voltage on the data line Tj can be applied to the gate of the current output TFT Q4 by turning on the selector TFT Q14.

Accordingly, to put the electro-optic device EL1 in a dark brightness state, preferably, a current is drawn from the source line Sj, a voltage less than or equal to the threshold voltage of the electro-optic device EL1 is applied to the source electrode Sj, and an OFF voltage is applied to the data line Tj. By so doing, the electro-optic device EL1 produces a completely dark state brightness.

In the arrangement, it is again preferred if the electro-optic device EL1 has diode-type asymmetric current characteristics.

Figure 29:
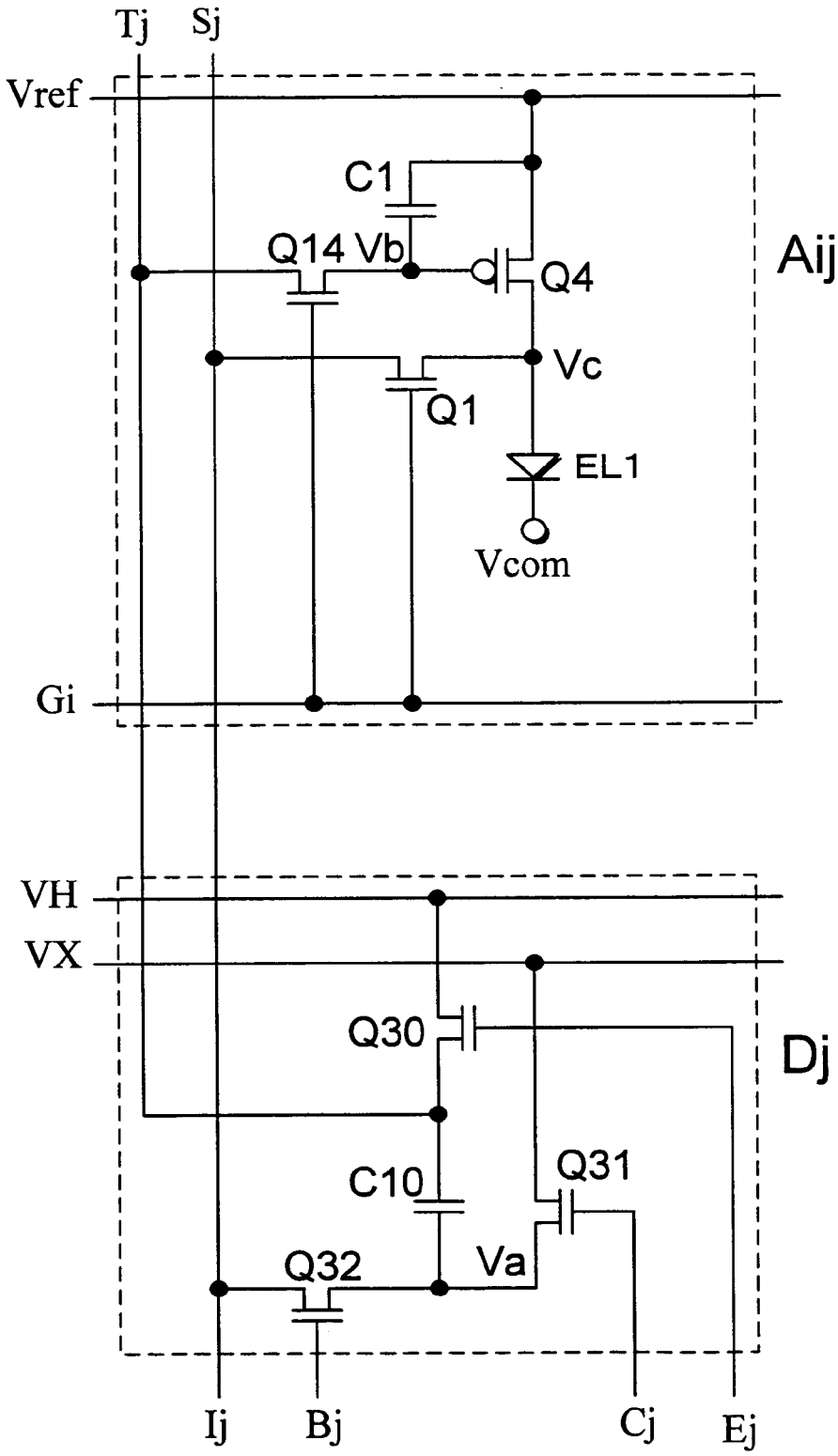
FIG. 29 is a circuit diagram showing an equivalent circuit for the output section of source driver circuitry in the display of the fifth embodiment in accordance with the present invention.

FIG. 29 shows an output section Dj of a source driver circuit for use in the FIG. 17 pixel circuit arrangement incorporating the electro-optic device EL1.

The output section Dj in FIG. 29 is located between the current driver circuit Pj and the pixel Aij in FIG. 17 and has a terminal Ij connected to an output current end (end of the source line Sj) of the current driver circuit Pj.

The output section Dj includes: a switching TFT (third switching device) Q30 between the data line Tj and the OFF voltage VH which is the voltage on a first set of voltage lines, wherein the data line Tj is connected to one of the two terminals of the capacitor (second capacitor) C10; a switching TFT (fourth switching device) Q32 between the source line Sj and the other terminal of the capacitor C10; and a switching TFT (fifth switching device) Q31 between that other terminal of the capacitor C10 and a compensation voltage VX which is the voltage on the second voltage line. The gate of the switching TFT Q30 is connected to the control line Ej, the gate of the switching TFT Q31 to the control line Cj, and the gate of the switching TFT Q32 to the control line Bj.

Figure 30:
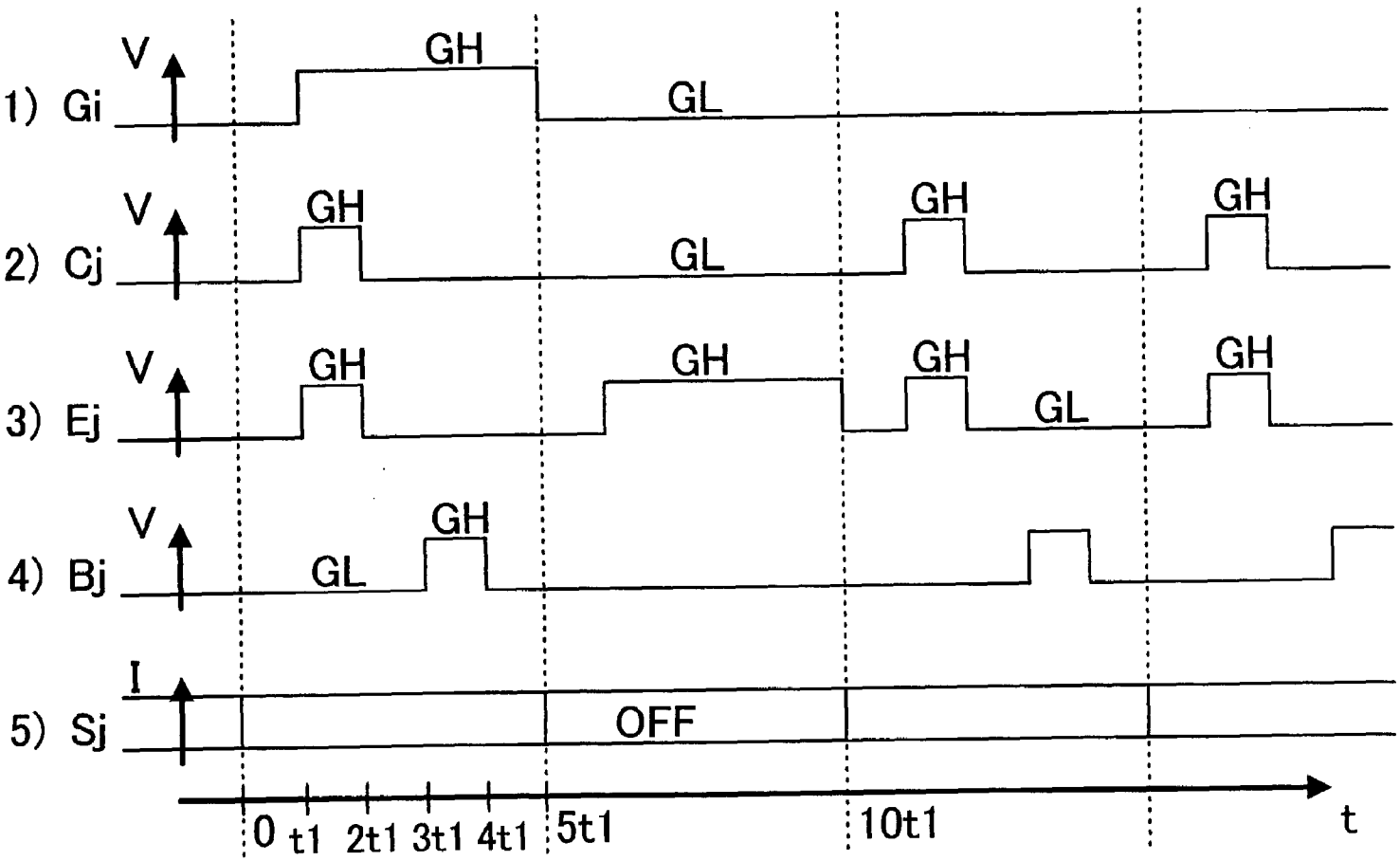
FIG. 30 is a timing diagram showing the operation of the FIG. 29 circuit.

FIG. 30 shows ON/OFF timings for the switching TFTs Q30, Q31, Q32 through the control lines Ej, Cj, Bj, as well as ON/OFF timings for the gate line Gi.

Figure 31:
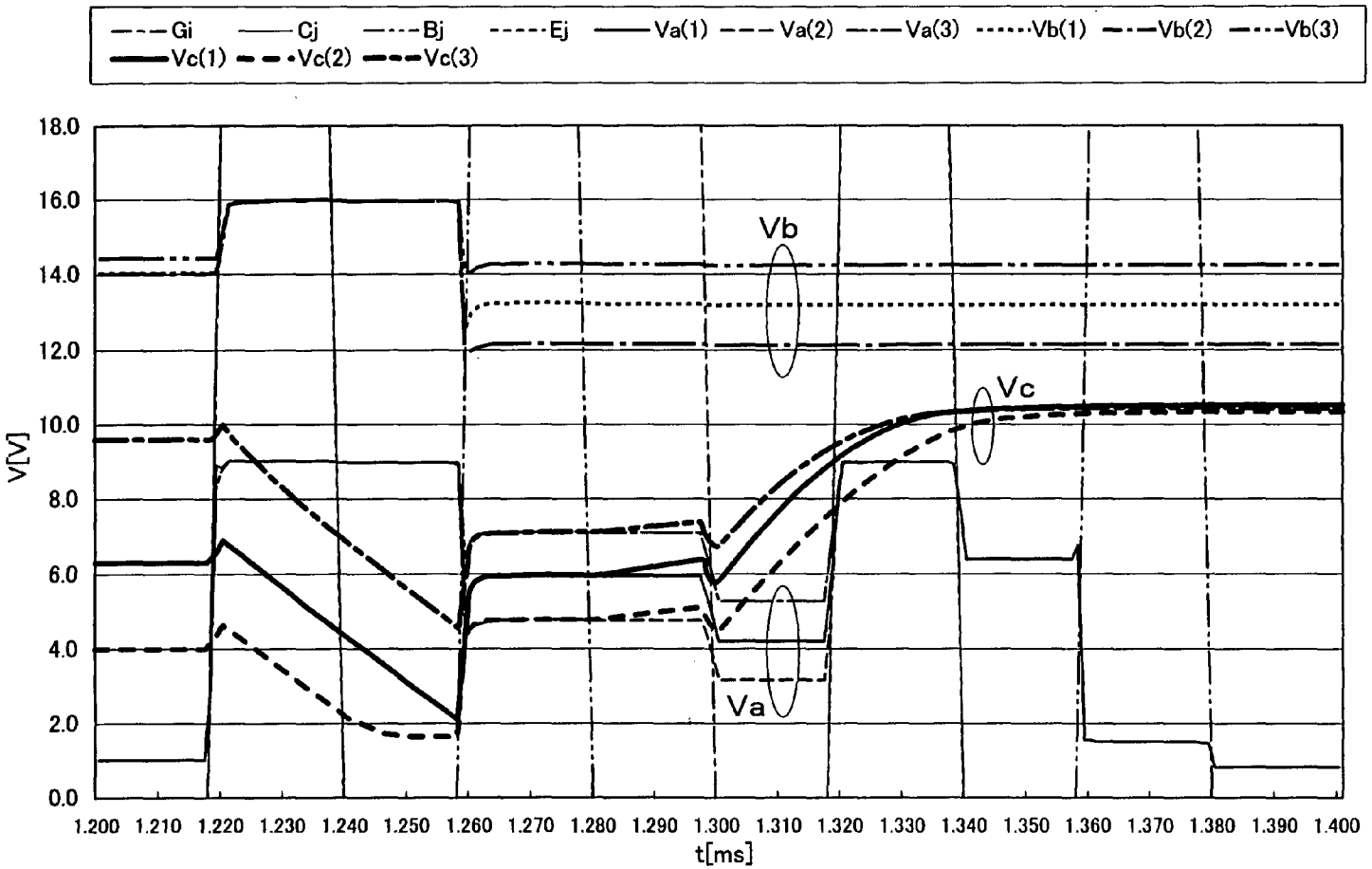
FIG. 31 is a timing diagram showing a simulation of the operation of the FIG. 29 circuit.

FIG. 31 shows results of the simulation of voltages at voltage measurement points Va, Vb, Vc in FIG. 29. Note that the voltage at the voltage measurement point Va in FIG. 29 is equal to that at the other terminal of the capacitor C10 (terminal to which the switching TFTs Q31, Q32 are coupled); the voltage at the voltage measurement point Vb is equal to the gate voltage of the current output TFT Q4; and the voltage at the voltage measurement point Vc is equal to the drain voltage of the current output TFT Q4.

The curves in FIG. 31 indicate results of simulation using three design values (maximum, median, and minimum) for the combination of the TFT threshold voltage and mobility in Table 1 for each of the voltages at the voltage measurement points Va, Vb, Vc. The simulation based on three values is carried out corresponding to the fact that the output current of the output section Dj which is a drive current for the electro-optic device EL1 varies with variations of TFT characteristics. The current variations are indicated as Ioled(1), Ioled(2), Ioled(3) in Table 1. In FIG. 31 the output currents Ioled(1), Ioled(2), Ioled(3) correspond respectively to Va(1) Va(2), Va(3) for the voltage measurement point Va, Vb(1), Vb(2), Vb(3) for the voltage measurement point Vb, and Vc(1), Vc(2), Vc(3) for the voltage measurement point Vc.

TABLE 1

| | Ioled(1) | Ioled(2) | Ioled(3) |
|---|---|---|---|
| Threshold Voltage | Mean Value | Minimum Value | Maximum Value |
| Mobility | Mean Value | Minimum Value | Maximum Value |

The following will describe the operation of the output section Dj and the pixel circuit Aij with reference to FIGS.

29–31. FIG. 31 also shows voltage variations on the gate line Gi and control lines Cj, Ej, Bj within the range of the graph.

The period lasting from 0 to 5t1 in FIG. 30 is a selection period. From t1 to 5t1 (from 1.22 ms to 1.30 ms in FIG. 31), the voltage on the gate line Gi is HIGH (the voltage rises at t1 and falls at 5t1), and the switching TFT Q1 and the selector TFT Q14 are conducting. From t1 to 2t1 (from 1.22 ms to 1.24 ms in FIG. 31) the voltages on the control lines Cj, Ej are both HIGH (the voltages rise at t1 and falls at 2t1), and the switching TFTs Q30, Q31 are conducting.

Thus, the voltage on the data line Tj is equal to the OFF voltage VH, which in turn renders the voltage at the voltage measurement point Vb (gate voltage of the current output TFT Q4) equal to the OFF voltage VH through the selector TFT Q14. The voltage at the voltage measurement point Va (voltage at the other terminal of the capacitor C10) becomes equal to the compensation voltage VX.

In FIG. 31, VH is specified as 16 V, and VX as 9 V. Voltage is 16 V at the voltage measurement point Vb and 9 V at the voltage measurement point Va.

From 3t1 to 4t1 (1.26 ms to 1.28 ms FIG. 31), the voltage on the control line Bj is HIGH (the voltage rises at 3t1 and falls at 4t1), and the switching TFT Q32 is conducting.

Thus, the voltage at the voltage measurement point Vc (drain voltage of the current output TFT Q4) matches the voltage at the voltage measurement point Va (voltage on the other terminal of the capacitor C10).

Besides, the data line Tj is connected only to the capacitors C1, C10; the voltage on the data line Tj is maintained. In the present embodiment, C1 is set to 1 pF, and C10 to 10 pF, so that the voltage across the capacitor C10 may vary little, if at all. For this reason, the difference between the voltage at the voltage measurement point Vb and that at the voltage measurement point Vc remains equal to the previous difference between the OFF voltage VH and the compensation voltage VX as shown in FIG. 31.

Thus, in a state where a specified current is drawn from the source driver circuit, the voltage at the voltage measurement point Vc is set lower than that at the voltage measurement point Vb by VH–VX (16 V−9 V=7 V in FIG. 31).

This voltage at the voltage measurement point Vc is applied to the anode of the electro-optic device EL1, preventing any substantial current from flowing through the electro-optic device EL1. Variations of the output current of the current output TFT Q4 caused by the presence of current flow through the electro-optic device EL1 can be restrained. The arrangement is therefore preferred.

Note that from 1.32 ms to 1.38 ms, only the control lines Cj, Ej, Bj repeat switching between HIGH and LOW similarly to from 1.22 ms to 1.28 ms.

Figure 32:
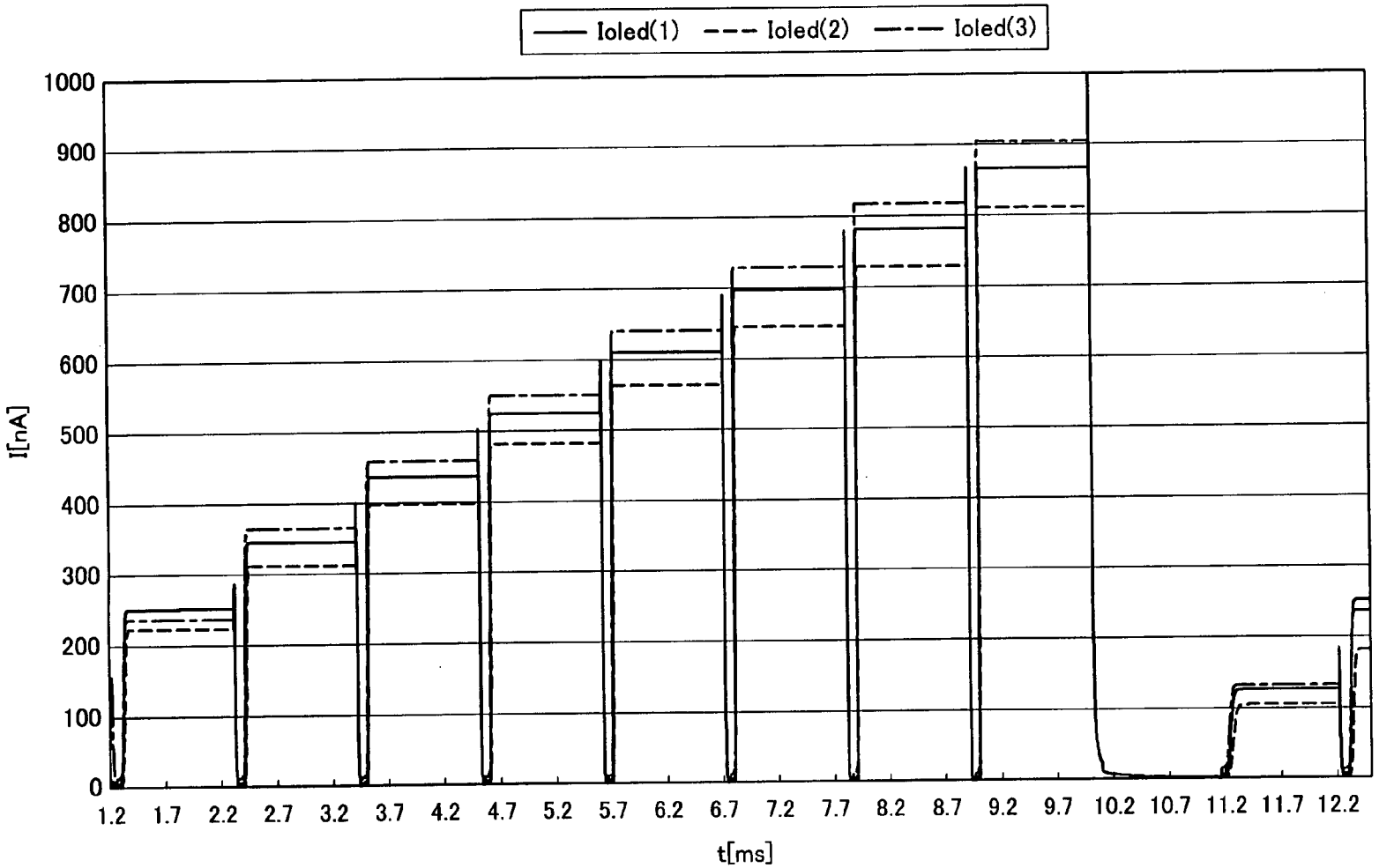
FIG. 32 shows results of the simulation of the current output of the FIG. 29 circuit.

As a result, as shown in the simulation results in FIG. 32, an output current is obtainable with restrained effects from variations in the current output TFT Q4 characteristics. FIG. 32 shows the values of the output current Ioled(1), Ioled(2), Ioled(3) in Table 1 as simulation results.

The simulation results in FIG. 32 were obtained by manipulating the current supply from the current driver circuit Pj so that it supplied 0.2 μA from 1.2 ms to 2.3 ms, incremented the current value by 0.1 μA every 1.1 ms, then supplied 0.9 μA from 8.9 ms to 10 ms, and again incremented the current value by 0.1 μA every 1.1 ms.

Although FIG. 32 indicates about 10% variations in current value, the omission of the switching TFT Q2 from the FIG. 27 circuit structure contributes to the greater OLED area in a bottom emission pixel (light comes out through the glass substrate on which TFTs are formed). The arrangement is therefore preferred.

Incidentally, the greater area the OLED has in a pixel, the lower the emission level per unit area in the part where the OLED is provided. The structure is preferable because it restrains degradation of the OLED and prolongs half-life in terms of brightness.

In the FIG. 29 structure, electric charge build-up in the capacitor C10 produces a potential difference between the source line Sj and the data line Tj. The voltage on the data line Tj can be hence suitably specified in passing a desired current to the current output TFT Q4. As a result, variations in output current of the current output TFT Q4 can be restrained. The arrangement is therefore preferred.

[Embodiment 6]

Figure 20:
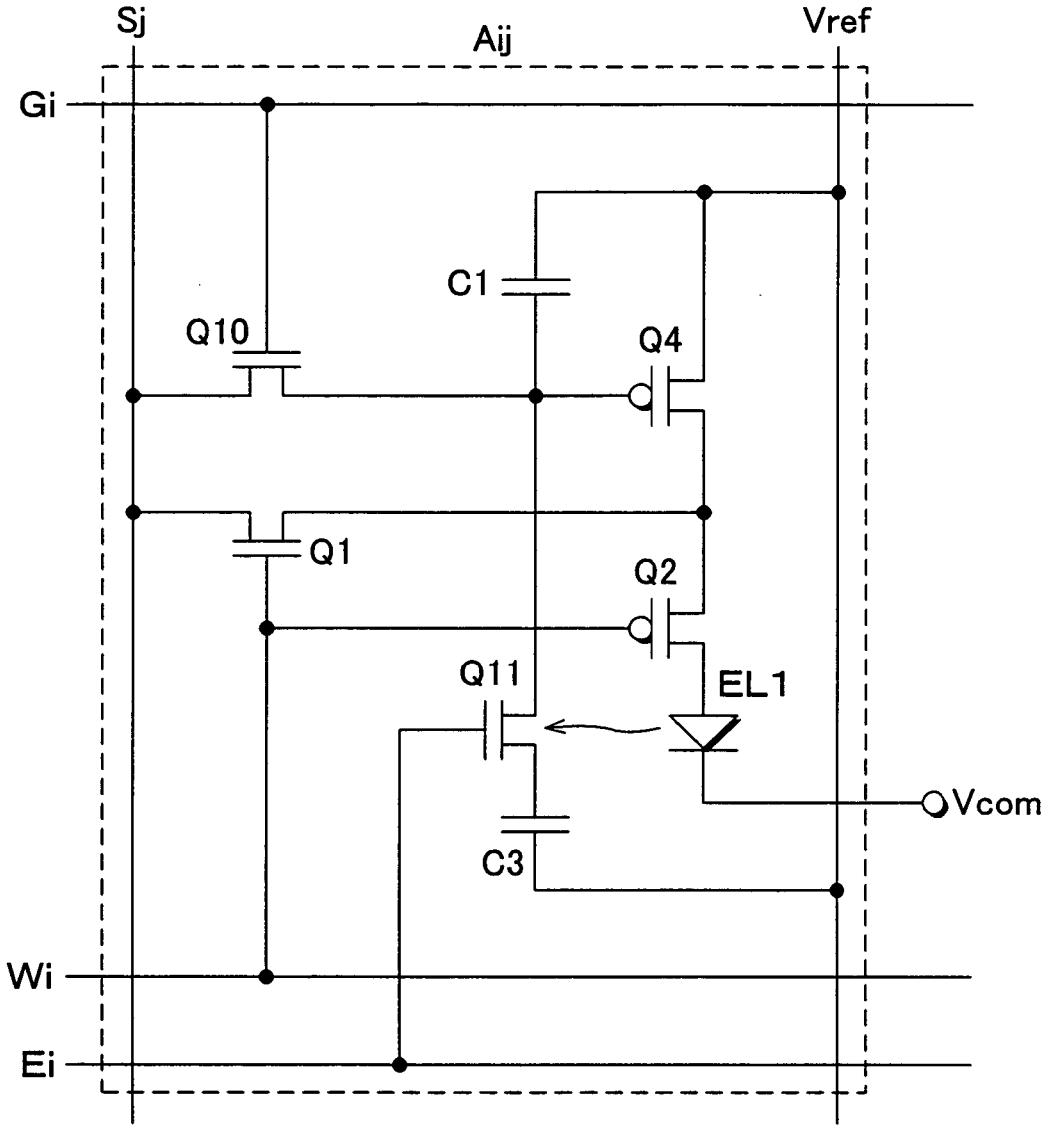
FIG. 20 is a circuit diagram showing an equivalent circuit for an application example of pixel circuitry in a display of the sixth embodiment in accordance with the present invention.
Figure 21:
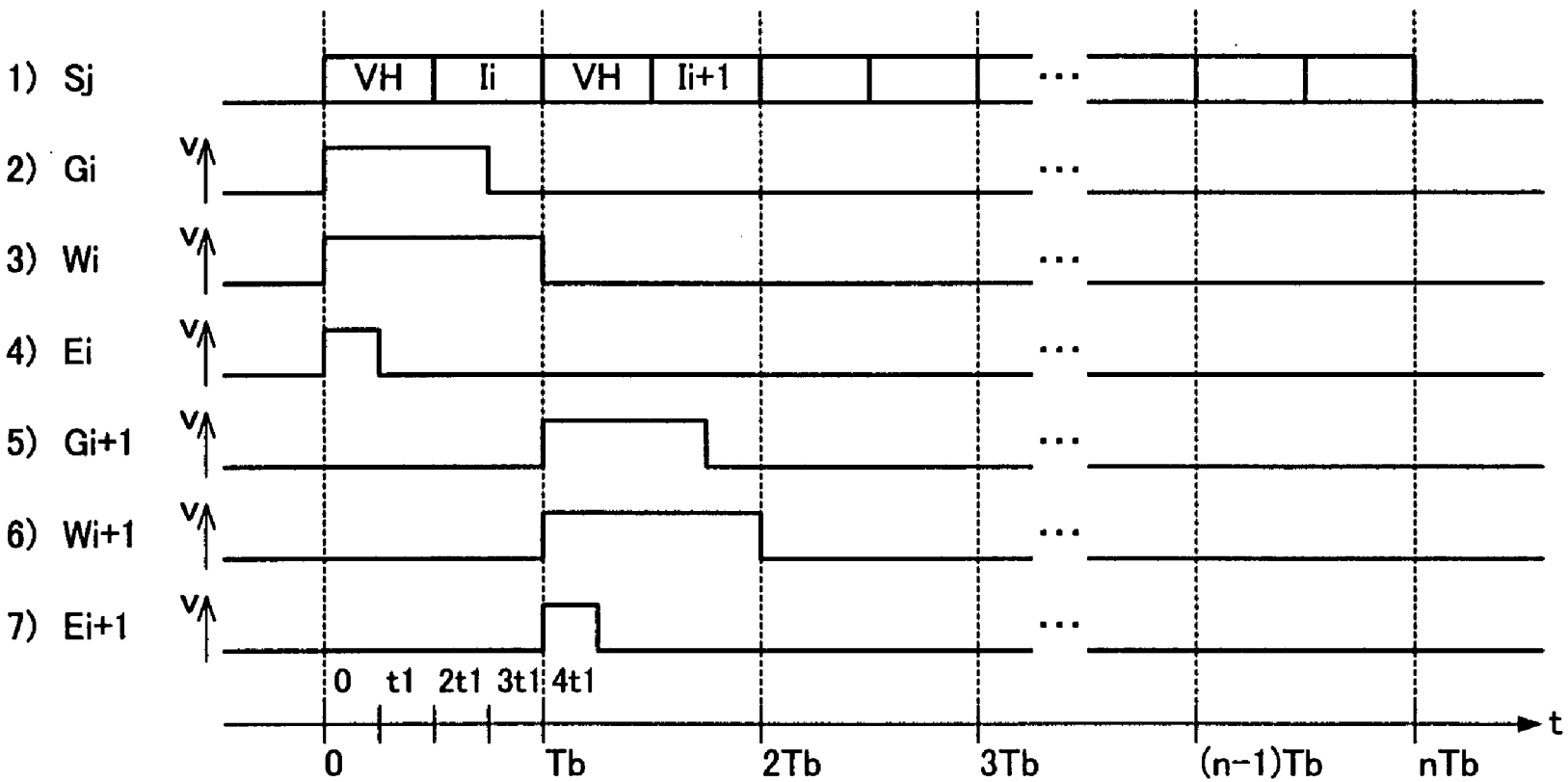
FIG. 21 is a timing diagram showing the operation of the FIG. 20 circuit.

The following will describe another embodiment in accordance with the present invention with reference to FIGS. 20, 21. Here, for convenience, members of the present embodiment that have the same function as members of embodiments 1 to 5, and that are mentioned in that embodiment are indicated by the same reference numerals and description thereof is omitted.

The use of an OLED display as an electro-optic device entails a problem that the current versus emission brightness characteristics of the OLED changes with time (brightness falls). The problem can be solved through an application of the pixel circuit structure in accordance with the present invention.

When this is the case, a light-receiving device composed of a capacitor C3 and a light-receiving TFT Q11 may be added to the pixels as shown in the FIG. 20 pixel circuit structure Aij.

The operation of the pixel circuit structure Aij starts with a selection period by setting the control line Wi to HIGH, turning off the switching TFT Q2, and turning on the switching TFT Q1 as shown in FIG. 21. Under these circumstances, the gate line Gi is also set to HIGH, turning on the selector TFT Q10, and the control line Ei is also set to HIGH, turning on the switching TFT Q11. Then, the OFF voltage of the current output TFT Q4 is applied to the source line Sj, developing the OFF voltage across the capacitor C3.

Next, the control line Ei is set to LOW, turning off the light-receiving TFT Q11.

Thereafter, a current is provided from the power source line Vref through the current output TFT Q4, the switching TFT Q1, and the source line Sj to the current driver circuit Pj (not shown). Under these circumstances, since the current driver TFT Q9 in the current driver circuit Pj is in constant current mode, the gate voltage of the current output TFT Q4 connected to the source line Sj is specified so that the current output TFT Q4 conducts the current.

The gate line Gi is then set to LOW, turning off the selector TFT Q10. The control line Wi is set to LOW, turning off the switching TFT Q1 and turning on the switching TFT Q2, concluding the select operation.

During the succeeding display period, light shone by the electro-optic device EL1 hits the light-receiving TFT Q11. Being hit by incident light, the Si TFT changes its OFF state current value. Electric charge moves from the capacitor C3 to the capacitor C1 in proportion to the received light.

As a result, the voltage across the capacitor C1 changes close to the OFF voltage VH. Under these circumstances, the more light the electro-optic device EL1 emits, the more quickly the voltage across the capacitor C1 changes close to the OFF voltage VH. Therefore, when the OLED is still new and has good current versus brightness characteristics, the voltage across the capacitor C1 quickly changes close to the OFF voltage VH; the current output TFT Q4 turns off in the middle of the display period. Meanwhile, as the OLED ages and exhibits poor current versus brightness characteristics, the current output TFT Q4 turns off near the end of the display period.

The OLED has a high brightness and a short emission time when it is new and a low brightness and long emission time when it has aged; brightness as integrated over the display period is therefore constant to some extent.

Uniform display is thus achieved over time regardless of degradation of OLED characteristics. The arrangement is therefore preferred.

Emitted light affects TFT characteristics in this manner. To prevent emission from the electro-optic device from adversely affecting the TFTs Q1, Q2, Q4, Q10 other than the light-receiving TFT Q11 in FIG. 20, a light shield layer may be provided on top of the TFT. A preferred light shield layer is a wiring electrode film used regularly in the TFT process.

In addition, to dispose ITO which acts as the anode of the electro-optic device EL1 also on the source line Sj, gate line Gi, power source line Vref, and TFT area, there may be provided a planarization insulating film on those lines and TFT; a contact hole through the insulating film to the current output terminal of the current output TFT Q4 or the TFT Q2 which is the second switching device; and the anode of the electro-optic device EL1 thereon.

Thus, the ITO acting as the anode of the electro-optic device EL1 may be formed overlapping the source line Sj, gate line Gi, power source line Vref, and TFT. The ITO edges are covered with another insulating film as much as necessary, and the electro-optic device is formed thereon. This enables the formation of the electro-optic device EL1 over the source line Sj, gate line Gi, power source line Vref, and TFT or near their edges. As a result, the light emission area can be increased in comparison to the case where no ITO is provided on those lines and TFT. As a result, required levels of brightness are achieved by driving using a relatively low voltage or electric current density. Degradation of characteristics of the electro-optic device EL1 is diminished.

The planarization insulating film preferably irregularly reflects incoming light for better light output efficiency. This is achieved by making the film from materials having differing refractive indices and, especially, by forming the film in a lens-like shape.

A film with high thermal conductivity is preferably provided on the surface of, or around, the electro-optic device, because the film prevents local temperature rise due to trapped light and heat.

The previous pixel circuit structure achieves required levels of tone stability using a small number of TFTs per pixel. The structure is thereby effective in reducing the number of TFTs per pixel and improving the panel yield ratio.

When an OLED is used as an electro-optic device, a temperature rise results in a brightness rise. At the same time, however, the current consumption of the panel rises. A preferred power source circuit structure therefore monitors the power source current for the panel and reduces voltage in accordance with the rise. A simple arrangement to achieve this is to equip the power source line with a resistance-like device which drops an increasing voltage with increasing current. A further preferred alternative is to change current capacity for each display pattern.

Figure 22:
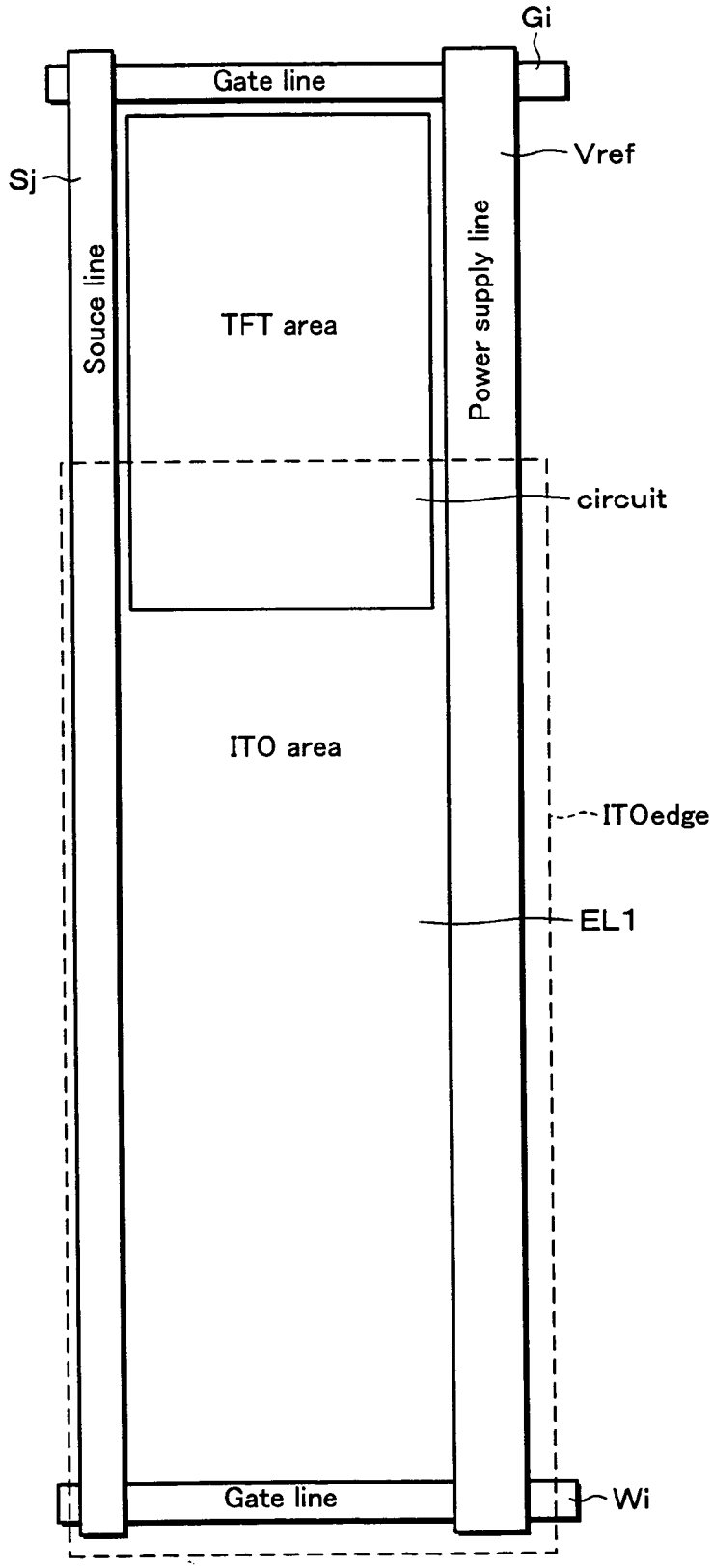
FIG. 22 is a plan view of a pixel wiring arrangement.
Figure 23:
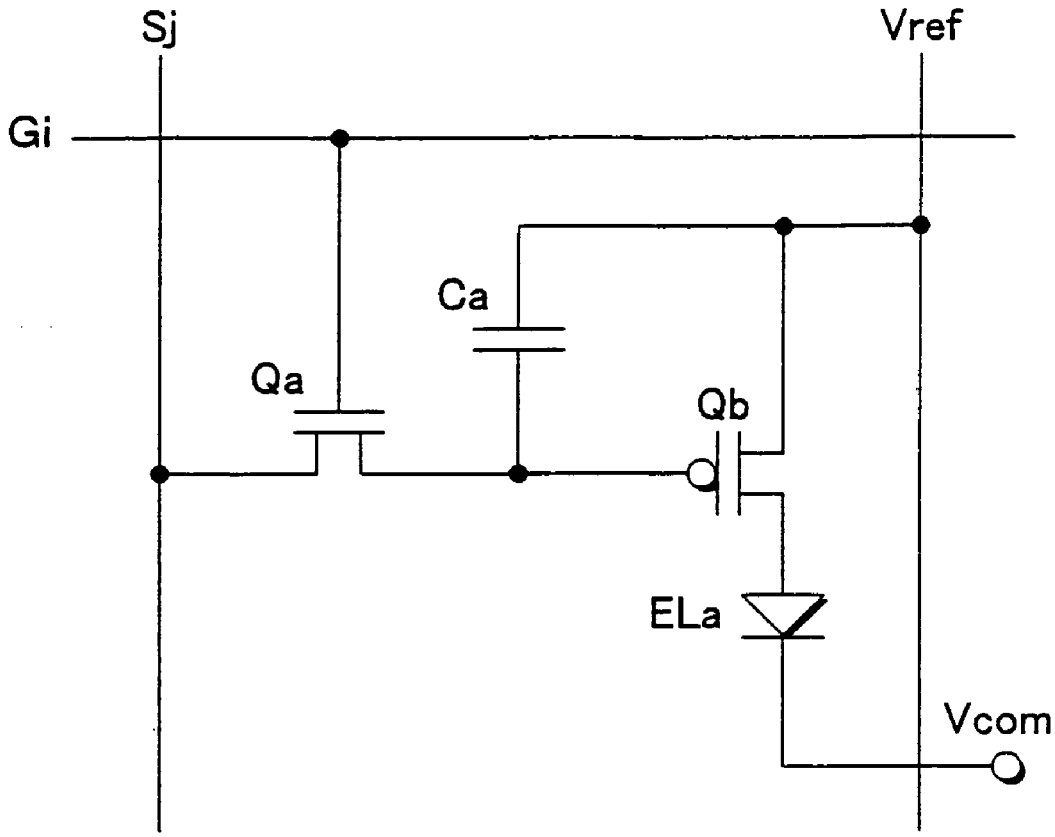
FIG. 23 (Prior Art)
FIG. 23 is a circuit diagram showing an equivalent circuit for pixel circuitry of a first conventional OLED.
Figure 24:
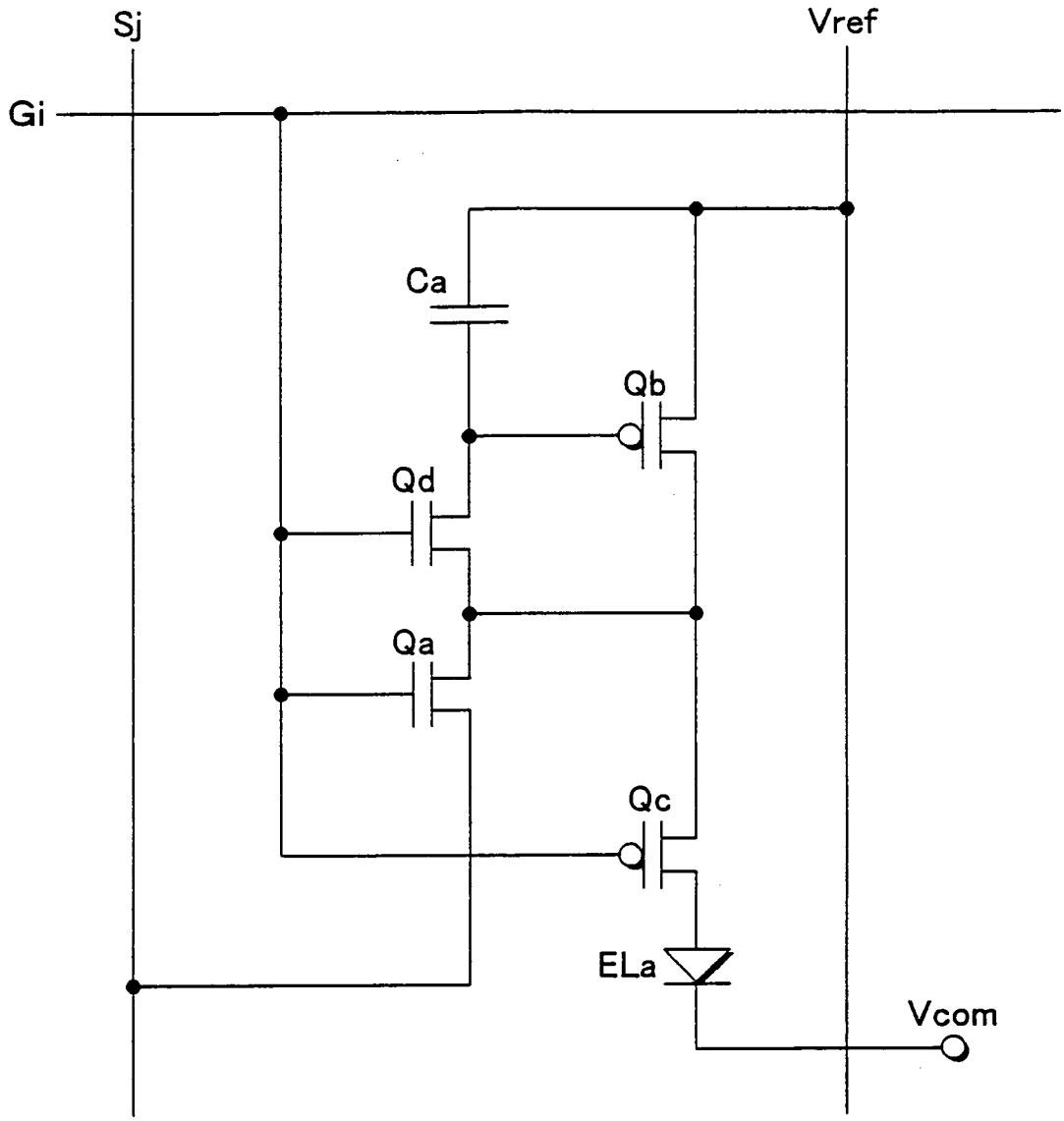
FIG. 24 (Prior Art)
FIG. 24 is a circuit diagram showing an equivalent circuit for pixel circuitry of a second conventional OLED.
Figure 25:
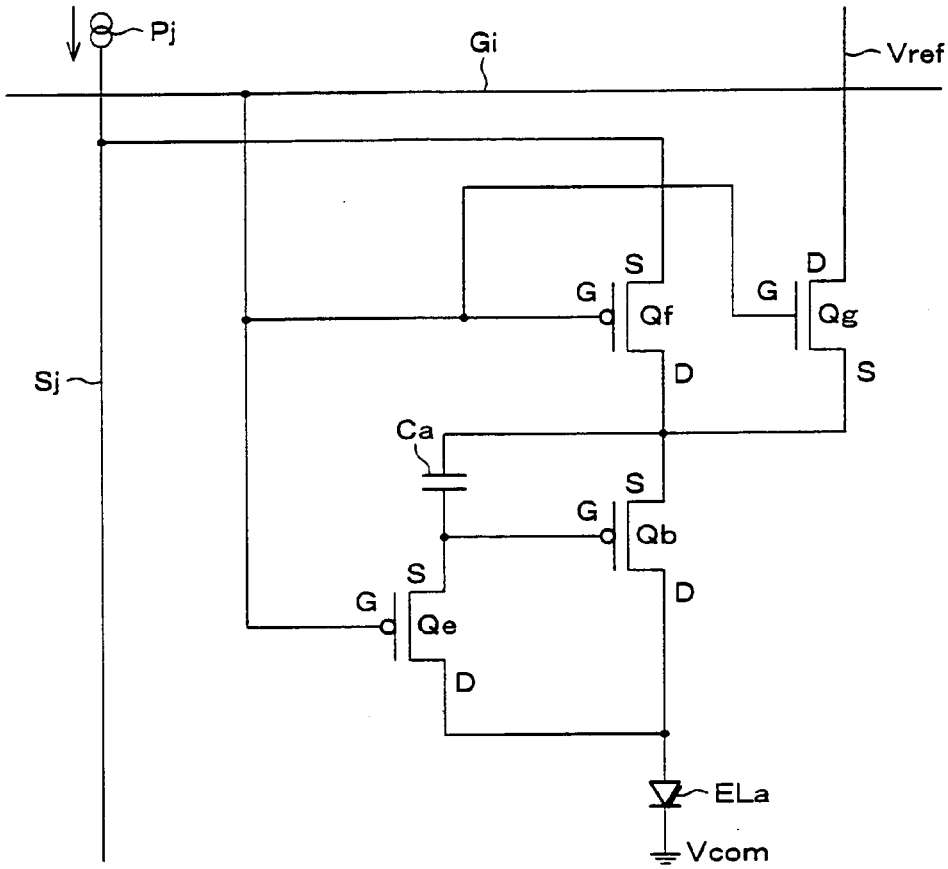
FIG. 25 (Prior Art)
FIG. 25 is a circuit diagram showing an equivalent circuit for pixel circuitry of a third conventional OLED.
Figure 26:
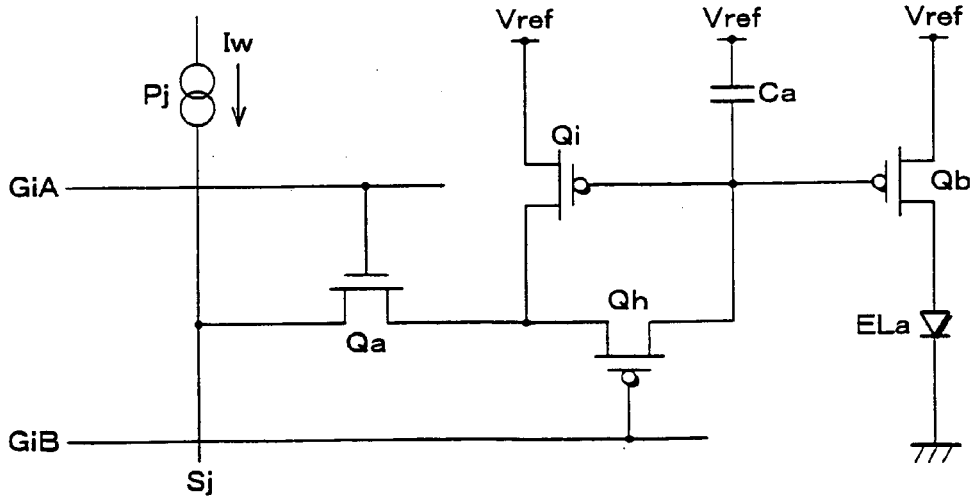
FIG. 26 (Prior Art)
FIG. 26 is a circuit diagram showing an equivalent circuit for pixel circuitry of a fourth conventional OLED.

Last of all, FIG. 22 shows a conceptual wiring sketch of the pixel Aij. A TFT circuit region and a transparent electrode region are provided surrounded by a source line Sj, gate line Gi, and power source line Vref.

As described so far, the display in accordance with the present invention is a display including: pixels provided at intersections of a first set of lines and a second set of lines, the pixels including respective current-driven electro-optic devices; and driver circuits which drive control the pixels through the first set of lines during a drive controllable period during which the pixels are drive controllable according to voltage states of the second set of lines, and characterized in that it includes a single constant current source, wherein the driver circuits generate a drive current to current drive the electro-optic devices and pass the drive current to the pixels through the first set of lines during the drive controllable period so as to drive control the pixels; create, and maintain, a circuit state where the drive current flows through the driver circuits to the pixels, using a constant current output from the constant current source during a non-drive controllable period; and generate the drive current during the drive controllable period in the maintained circuit state.

According to the arrangement, the driver circuit creates, and maintains, a circuit state where a drive current for the electro-optic device flows through the driver circuit, using a constant current output from a single constant current source during a non-drive controllable period for the pixel. The driver circuit performs the process on each pixel. The driver circuits however use a constant current source common to the pixels, and exhibit reduced variations in output characteristics, owing to the constant current value. As a result, a circuit state is maintained which precisely corresponds to the drive current setting for each pixel. The driver circuit generates, in the maintained circuit state, the drive current for a pixel which is in a drive controllable period according to the voltage state of the second set of lines, and pass the drive current through the first set of lines, so as to drive control the pixel. In the pixel receiving the drive current, the drive current flows through the electro-optic device to effect a display.

The driver circuit does not output high frequency current, because unlike the arrangement where a different current driver circuit is provided for each panel (or each color, RGB) to switch between currents for every pixel in drive control, the driver circuit is set for a drive current corresponding to the first set of lines using a single constant current source during a non-drive controllable period, and the driver circuit is used to specify the current value for the pixel. Therefore, the pixel can be made using low temperature polysilicon TFTs, CG silicon TFTs, or the like.

This realizes a display in which the current driver circuit for the electro-optic device is formed from low temperature polysilicon TFTs, CG silicon TFTs, or the like, while preventing current from varying from one source line to another.

The display in accordance with the present invention is further characterized in that a current drive period during which the drive current flows through the electro-optic devices has a duration determined by a selective combination of periods in a constant period.

According to the arrangement, the electro-optic device is current driven throughout a current drive period of which the duration is determined by a selective combination of periods in a constant period. In a constant period, more tones are displayed than dictated by a drive current value passed from the driver circuit.

The display in accordance with the present invention is further characterized in that the pixels each include: a first active device which generates and passes the drive current to the electro-optic devices when the electro-optic devices are current driven; a first capacitor which maintains conditions of a voltage applied to the first active device so as to cause the first active device to generate, when the electro-optic devices are current driven, the drive current passed from an associated one of the driver circuits, during the drive controllable period; a second active device which, during the drive controllable period, conducts and passes the drive current from the associated driver circuit to the first active device so as to cause the first active device to create the conditions and which, after the conditions are created, does not conduct so as to cause the first capacitor to maintain the conditions; and a first switching device which conducts to connect the pixels to the first set of lines, starts the drive controllable period, and causes the first capacitor to maintain the conditions by the first capacitor.

According to the arrangement, as the first switching device conducts, the first switching device connect the pixel to the first set of lines, starting the drive controllable period. By the second active device starts conducting during the drive controllable period, a drive current is passed from the driver circuit to the first active device, and voltage conditions are created which are applied to the first active devices so that the first active device generates the drive current which is passed through the electro-optic device in current driving the electro-optic device. Then, as the second active device stops conducting, the created voltage conditions are maintained by the first capacitors. Further, after this, as the first switching device stops conducting, the pixel is disconnected from the first set of lines, ending the drive controllable period and allowing for current drive in which a drive current flows from the first active device to the electro-optic device in the voltage conditions maintained by the first capacitor.

Thus, the electro-optic device can be driven by a drive current passed from the driver circuit.

The display in accordance with the present invention is further characterized in that it also includes a third set of lines which pass, through the conducting second active device rather than the first switching device to the first active device, a voltage required for the first active device to create the conditions, wherein the first switching device conducts so as to connect the first set of lines to a current output terminal of the first active device.

According to the arrangement, when the second active device is conducting, a voltage required for the first active device to create the voltage conditions is passed from the third set of line through the second active device rather than the first switching device to the first active device. Then, as the first switching device starts conducting, the first set of lines is connected to the current output terminals of the first active devices. Therefore, a diode-type electro-optic device with a threshold voltage can be made to appear completely dark by passing a voltage which inhibits the first active device from conducting from the third set of lines through the second active device to the first active device and passing, from the first set of line through the first switching device to the current output terminal of the first active device, such a voltage that the voltage applied to the electro-optic device is less than or equal to the threshold voltage.

The display in accordance with the present invention is further characterized in that it also includes a fourth set of lines which pass, to the first switching device, a voltage switching the first switching device between a conducting state and a non-conducting state.

According to the arrangement, a voltage switching the second active device between a conducting state and a non-conducting state to the second active device is routed via, for example, the second set of lines to pass, and a voltage switching the first switching device between a conducting state and a non-conducting state to the first switching devices is routed via, for example, the fourth set of lines. This ensures that the generated voltage is inhibited from being adversely affecting and changing from the voltage conditions as a result of the switching of the first switching devices before the first capacitor comes to maintain the voltage conditions, and that the first switching device is rendered non-conducting after the first capacitor comes to maintain the voltage conditions.

Besides, after causing the first capacitor to maintain the voltage conditions, the first set of lines is disconnected from the driver circuit, rendering the first switching device non-conducting.

Thereafter, to render the first active device non-conducting, the first set of lines is connected to an OFF voltage; to keep the first active device conducting, the path between the first set of lines and the driver circuit is kept open. Thereafter, the second active device is rendered non-conducting.

By so doing, the first active device is rendered non-conducting without passing a current through the electro-optic device.

The provision of the fourth set of lines enables the first switching device to switch between the conducting state and the non-conducting state, independently of the state of the second active device. The duration of the current drive period for the electro-optic device is controllable by passing to the second active device such a voltage that the first active device is rendered non-conducting while the electro-optic device is being current driven.

The display in accordance with the present invention is further characterized in that it also includes a second switching device which opens/closes a path for the drive current to flow from the first active device to the associated one of the electro-optic devices.

According to the arrangement, the path along which the drive current flows from the first active device to the electro-optic device can be opened/closed by the second switching device. This readily enables current drive of a diode-type electro-optic device with a threshold voltage.

The display of the display in accordance with the present invention is a display including driver circuits which drive control pixels provided at intersections of a first set of lines and a second set of lines, the pixels including respective current-driven electro-optic devices, through the first set of lines during a drive controllable period during which the pixels are drive controllable according to voltage states of the second set of lines, the driver circuits generating a drive current to current drive the electro-optic devices and passing the drive current to the pixels through the first set of lines during the drive controllable period, so as to drive control the pixels, and is characterized in that the driver circuits create, and maintain, a circuit state where the drive current flows through the driver circuits to the pixels, using a constant current output from a single constant current source during a non-drive controllable period; and generate the drive current during the drive controllable period in the maintained circuit state.

According to the arrangement, the drive current for the driver circuits is specified using a single constant current source so as to reduce variations in output characteristics of the driver circuits. This is preferred because it reduces variations in the output current of the driver circuits.

This realizes a display in which the current driver circuit for the electro-optic device is formed from low temperature polysilicon TFTs, CG silicon TFTs, or the like, while preventing current from varying from one source line to another.

The display in accordance with the present invention is a display including electro-optic devices provided at intersections of a first set of lines and a second set of lines, and further is characterized in that it also includes: first active devices provided in series with the electro-optic devices; first capacitors connected to control terminals of the first active devices; second active devices provided between the first set of lines and the first capacitors; first switching devices provided between the first set of lines and current output terminals of the first active devices; and a fourth set of lines connected to control terminals of the first switching devices.

According to the arrangement, the first switching device and the second active device are made to conduct, and a predetermined current is passed from the first active device through the first switching device to the first set of lines, so as to generate a voltage to be maintained by the first capacitor. Besides, the second active devices is rendered conducting, so as to maintain the voltage.

Therefore, by employing a driver circuit which passes the predetermined current based on a constant current output from a single constant current source as the current driver circuit for the electro-optic device, variations in output characteristics of the driver circuits are reduced owing to the constant current value. This realizes a display in which the current driver circuit for the electro-optic device is formed from low temperature polysilicon TFTs, CG silicon TFTs, or the like, while preventing current from varying from one source line to another.

The display in accordance with the present invention is a display including electro-optic devices provided at intersections of a first set of lines and a second set of lines, and is further characterized in that it also includes: a third set of lines provided in parallel with the first set of lines; first active devices provided in series with the electro-optic devices; first capacitors connected to control terminals of the first active devices; second active devices provided between the third set of lines and the first capacitors; and first switching devices provided between the first set of lines and current output terminals of the first active devices.

According to the invention, the first set of lines is connected to the third set of lines, to electrically coupling the first switching device to the second active device, so as to pass a predetermined current from the first active device through the first switching device to the first set of lines. Thus, a voltage is generated which is to be maintained by the first capacitor.

Therefore, by employing a driver circuit which passes the predetermined current based on a constant current output from a single constant current source as the current driver circuit for the electro-optic device, variations in output characteristics of the driver circuits are reduced owing to the constant current value. This realizes a display in which the current driver circuit for the electro-optic device is formed from low temperature polysilicon TFTs, CG silicon TFTs, or the like, while preventing current from varying from one source line to another.

Besides, the first set of lines is separated from the third set of lines, to electrically coupling the first switching device to the second active device, and a predetermined voltage is applied to the third set of lines, so as to make the first active devices non-conducting. This is preferred because it sufficiently reduces the current value for the first active device in conducting state.

The display, especially, in the pixel circuit structure, further includes second switching devices provided between the electro-optic devices and the first active devices.

According to the arrangement, the output current of the first active device is directed to the first set of lines regardless of characteristics of the electro-optic device. The current control terminal voltage can therefore be specified so that the first active device produces a desired current when the first set of line is electrically coupled to the third set of lines. This is preferred because it reduces variations in the output current of the first active device.

Besides, the first active device is rendered non-conducting by electrically isolating the first set of lines from the third set of lines and applying a predetermined voltage to the third set of lines. This is preferred because it sufficiently reduces the current value for the first active device in non-conducting state.

The display, especially, is a display in which the fourth set of lines is connected to control terminals of the second switching devices.

According to the arrangement, the second switching device is switched between the conducting/non-conducting states according to the voltage states of the fourth set of lines, independently from the first active devices being switched between the conducting/non-conducting states. The electro-optic devices can be lit off while maintaining the control terminal voltage of the first active device.

The display, especially, is a display in which the conducting/non-conducting states of the first switching devices and the second active devices are controlled through different sets of lines.

According to the arrangement, the second active device and the first switching device are independently controllable. The first switching device can be rendered non-conducting after the second active device is rendered non-conducting. As a result, while the first active device is conducting a predetermined current, the voltage across the first active device can be maintain by the first capacitor. This is preferred because it reduces variations in output current value.

Further, it is preferred if the output terminals of the driver circuits for the display are arranged so that second capacitors connected to the third set of lines; third switching devices provided between the third set of lines and a first set of voltage lines; fourth switching devices provided between the second capacitors and the first set of lines; and fifth switching devices provided between the second capacitors and a second set of voltage lines.

According to the arrangement, as the second capacitor charges, a voltage difference occurs between the first set of lines and the third set of lines. As a result, the voltage on the third set of lines can be suitably specified when passing a desired current to the first active devices. This is preferred because it reduces variations in output current of the first active device.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A display, comprising:

pixels provided at intersections of a first set of lines and a second set of lines, the pixels including respective current-driven electro-optic devices;

driver circuits which drive control the pixels through the first set of lines during a drive controllable period during which the pixels are drive controllable according to voltage states of the second set of lines; and a single constant current source, wherein the driver circuits generate a drive current to current drive the electro-optic devices and pass the drive current to the pixels through the first set of lines during the drive controllable period so as to drive control the pixels; create, and maintain, a circuit state where the drive current flows through the driver circuits to the pixels, using a constant current output from the constant current source during a non-drive controllable period; and generate the drive current during the drive controllable period in the maintained circuit state.

2. The display as set forth in claim 1, wherein a current drive period during which the drive current flows through the electro-optic devices has a duration determined by a selective combination of periods in a constant period.

3. The display as set forth in claim 1, wherein the pixels each include:

a first active device which generates and passes the drive current to the electro-optic devices when the electro-optic devices are current driven;

a first capacitor which maintains conditions of a voltage applied to the first active device so as to cause the first active device to generate, when the electro-optic devices are current driven, the drive current passed from an associated one of the driver circuits during the drive controllable period;

a second active device which, during the drive controllable period, conducts and passes the drive current from the associated driver circuit to the first active device so as to cause the first active device to create the conditions and which, after the conditions are created, does not conduct so as to cause the first capacitor to maintain the conditions; and a first switching device which conducts to connect the pixels to the first set of lines, starts the drive controllable period, and causes the first capacitor to maintain the conditions by the first capacitor.

4. The display as set forth in claim 3, further comprising a third set of lines which pass, through the conducting second active device rather than the first switching device to the first active device, a voltage required for the first active device to create the conditions, wherein the first switching device conducts so as to connect the first set of lines to a current output terminal of the first active device.

5. The display as set forth in claim 3, further comprising a fourth set of lines which pass, to the first switching device, a voltage switching the first switching device between a conducting state and a non-conducting state.

6. The display as set forth in claim 3, wherein the pixels each further include a second switching device which opens/closes a path for the drive current to flow from the first active device to the associated one of the electro-optic devices.

7. A display, comprising driver circuits which drive control pixels provided at intersections of a first set of lines and a second set of lines, the pixels including respective current-driven electro-optic devices, through the first set of lines during a drive controllable period during which the pixels are drive controllable according to voltage states of the second set of lines, the driver circuits generating a drive current to current drive the electro-optic devices and passing the drive current to the pixels through the first set of lines during the drive controllable period, so as to drive control the pixels, wherein the driver circuits create, and maintain, a circuit state where the drive current flows through the driver circuits to the pixels, using a constant current output from a single constant current source during a non-drive controllable period; and generate the drive current during the drive controllable period in the maintained circuit state.

8. A display, comprising:

electro-optic devices provided at intersections of a first set of lines and a second set of lines;

first active devices provided in series with the electro-optic devices;

first capacitors connected to control terminals of the first active devices;

second active devices provided between the first set of lines and the first capacitors, and wherein control terminals of the second active devices are connected to the second set of lines;

first switching devices provided between the first set of lines and current output terminals of the first active devices; and a third set of lines connected to control terminals of the first switching devices.

9. A display, comprising:

electro-optic devices provided at intersections of a first set of lines and a second set of lines;

a third set of lines provided in parallel with the first set of lines and the third set of lines being of different lines than power source lines;

first active devices provided in series with the electro-optic devices, the first active devices and the electro-optic devices being provided between one of said power source lines and an opposing electrode;

first capacitors connected to control terminals of the first active devices;

second active devices provided between the thirdset of lines and the first capacitors; and first switching devices provided between the first set of lines and current output terminals of the first active devices.

10. The display as set forth in claim 8, further comprising second switching devices provided between the electro-optic devices and the first active devices.

11. The display as set forth in claim 9, further comprising second switching devices provided between the electro-optic devices and the first active devices.

12. The display as set forth in claim 10, wherein a fourth set of lines is connected to control terminals of the second switching devices.

13. The display as set forth in claim 11, further comprising a fourth set of lines connected to control terminals of the second switching devices.

14. The display of claim 9, further comprising means for selectively coupling one of the first set of lines to a corresponding one of the third set of lines.

15. A display, comprising:

electro-optic devices provided at intersections of a first set of lines and a second set of lines;

a third set of lines provided in parallel with the first set of lines;

first active devices provided in series with the electro-optic devices;

first capacitors connected to control terminals of the first active devices;

second active devices provided between the thirdset of lines and the first capacitors;

first switching devices provided between the first set of lines and current output terminals of the first active devices;

second capacitors connected to the third set of lines;

second switching devices provided between the third set of lines and a first set of voltage lines;

third switching devices provided between the second capacitors and the first set of lines, the third switching devices being opposite to the third set of lines with respect to the second capacitors; and fourth switching devices provided between the second capacitors and a second set of voltage lines, the fourth switching devices being opposite to the third set of lines with respect to the second capacitors.

* * * * *

UNITED STATES PATENT AND TRADEMARK OFFICE

CERTIFICATE OF CORRECTION

PATENT NO. : 7,205,966 B2
APPLICATION NO. : 10/656299
DATED : April 17, 2007
INVENTOR(S) : T. Numao It is certified that error appears in the above-identified patent and that said Letters Patent is hereby corrected as shown below:

(*) Notice and Item (45):

Delete "This patent is subject to a terminal disclaimer".

Signed and Sealed this

Seventh Day of August, 2007

JON W. DUDAS
*Director of the United States Patent and Trademark Office*